US007033015B2

(12) United States Patent
Takagi

(10) Patent No.: US 7,033,015 B2
(45) Date of Patent: Apr. 25, 2006

(54) INKJET PRINTER

(75) Inventor: Osamu Takagi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/901,245

(22) Filed: Jul. 29, 2004

(65) Prior Publication Data

US 2005/0024464 A1 Feb. 3, 2005

(30) Foreign Application Priority Data

Jul. 31, 2003 (JP) ..... 2003-284528

(51) Int. Cl.
*B65H 23/04* (2006.01)

(52) U.S. Cl. ..... 347/104; 226/2; 226/10; 226/27

(58) Field of Classification Search ..... None
See application file for complete search history.

(56) References Cited

U.S. PATENT DOCUMENTS 3,606,117 A * 9/1971 Fagan et al. ..... 226/2
4,753,379 A * 6/1988 Blasberg et al. ..... 148/510
5,628,574 A * 5/1997 Crowley ..... 400/621
5,740,054 A * 4/1998 Durr et al. ..... 700/122

FOREIGN PATENT DOCUMENTS

JP A 10-139239 5/1998
JP A 2001-287377 10/2001

* cited by examiner

*Primary Examiner*—Andrew H. Hirshfeld
*Assistant Examiner*—Jill E. Culler
(74) *Attorney, Agent, or Firm*—Oliff & Berridge PLC

(57) ABSTRACT

An inkjet printer includes a conveyance belt including a groove, a conveyance mechanism, a cutting mechanism, a control unit, and a judgment unit. After the cutting mechanism cuts the printing medium, The judgment unit judges whether or not a cut position of the printing medium will be located in a predetermined region of the conveyance belt if the conveyance mechanism drives the conveyance belt to convey the printing medium in the direction opposite to the conveyance direction. The predetermined region of the conveyance belt includes the groove. When the judgment unit judges that the cut position of the printing medium will be located in the predetermined region, the control unit controls the conveyance mechanism to convey the printing mechanism on the conveyance belt in the conveyance direction and subsequently controls the cutting mechanism to cut the printing medium.

10 Claims, 14 Drawing Sheets

INKJET PRINTER

BACKGROUND OF THE INVENTION

1. Field of the Invention

The present invention relates to an inkjet printer for ejecting ink onto a printing medium to thereby form an image.

2. Description of the Related Art

According to a related art, in an inkjet printer of an inkjet type for ejecting very small ink droplets from ejection holes of an inkjet head onto a recording medium so as to form a desired image, a satisfactory image can be obtained when ink ejection from the vary small ejection holes is kept good. It is therefore necessary to prevent thickened ink droplets or foreign matters from adhering to the ejection holes. To this end, in the related art, an operation of so-called flushing is performed independently of an operation of image formation. That is, ink is ejected from the ejection holes so as to remove thickened ink droplets or foreign matters.

In a serial type inkjet printer, the flushing operation can be performed in a region other than a printing medium conveyance portion because an inkjet head is movable in the width direction of a printing medium. However, in a fixed line head type inkjet printer using a conveyance belt for conveying a printing medium, ink is ejected onto the conveyance belt at the time of flushing because a recording head is fixed with respect to a printing medium conveyance portion. Accordingly, in the fixed line head type inkjet printer in the related art, an ink reception region such as a groove or an opening portion is provided in the conveyance belt. Ink is ejected only to the ink reception region at the time of flushing. Thus, the ink is prevented from adhering to the conveyance surface carrying the printing medium thereon (for example, see JP-A-2001-2873771 (pages 4 to 5; and FIG. 3)).

Inkjet printers generally use cut paper as printing media. In recent years, inkjet printers are used for various expanded applications. There is an increasing demand for recording not only on the cut paper but also on a long printing medium rolled up, such as roll paper.

In a typical inkjet printer using roll paper, the roll paper is set upstream in the printing medium feed direction, while the front end of the roll paper is set at the entrance of the conveyance path. Image recording is performed with the roll paper being carried and conveyed on a conveyance belt by a pinch roller (e.g. JP-A-Hei. 10-139239 (pages 4 to 5; and FIG. 1)).

SUMMARY OF THE INVENTION

In the configuration where an image is formed on roll paper in the inkjet printer having an ink reception region in the conveyance belt as described above, however, the to-be-rewound-side front end of the roll paper may be located in the ink reception region of the conveyance belt when the roll paper is cut in a predetermined position by a cutting mechanism after image formation, and the remaining paper is rewound. In this event, there is a fear that ink adhering to the ink reception region adheres to the roll paper.

It is therefore an object of the invention to solve the foregoing problems. The invention provides an inkjet printer in which the front end of a printing medium is prevented from falling into an ink reception region of a conveyance belt to thereby contaminate the printing medium with ink when the printing medium is rewound.

According to one embodiment of the invention, an ink-jet printer includes an inkjet head, a conveyance belt, a conveyance mechanism, a cutting mechanism, a control unit, and a judgment unit. The inkjet head ejects ink onto a printing medium to form an image thereon. The conveyance belt defines on an outer circumferential surface thereof a groove extending in a direction intersecting with a conveyance direction. The conveyance mechanism drives the conveyance belt to travel in the conveyance direction and in a direction opposite to the conveyance direction. The cutting mechanism is disposed downstream in the conveyance direction with respect to the conveyance belt and cuts the printing medium. The control unit controls at least the conveyance mechanism and the cutting mechanism. The judgment unit, after the cutting mechanism cuts the printing medium, judges whether or not a cut position of the printing medium will be located in a predetermined region of the conveyance belt if the conveyance mechanism drives the conveyance belt to convey the printing medium in the direction opposite to the conveyance direction. The predetermined region of the conveyance belt includes the groove. When the judgment unit judges that the cut position of the printing medium will be located in the predetermined region, the control unit controls the conveyance mechanism to convey the printing mechanism on the conveyance belt in the conveyance direction and subsequently controls the cutting mechanism to cut the printing medium. When the judgment unit judge that the cut position of the printing medium will not be located in the predetermined region, the control unit controls the conveyance mechanism to convey the printing medium on the conveyance belt in the direction opposite to the conveyance direction.

According to one embodiment of the invention, an ink-jet printer includes an inkjet head, a feeding mechanism, a conveyance belt, a conveyance mechanism, a cutting mechanism, a control unit, a determination unit, and a calculation unit. The inkjet head ejects ink onto a printing medium to form an image thereon. The feeding mechanism feeds the printing medium in a conveyance direction. The conveyance belt defines on an outer circumferential surface thereof a groove extending in a direction intersecting with the conveyance direction. The conveyance mechanism drives the conveyance belt to travel in the conveyance direction and in a direction opposite to the conveyance direction. The cutting mechanism is disposed downstream in the conveyance direction with respect to the conveyance belt and cuts the printing medium. The control unit controls at least the feeding mechanism, the conveyance mechanism, and the cutting mechanism. The determination unit determines a to-be-cut position of the printing medium based on image data. The calculation unit calculates a timing at which if the feeding mechanism begins feeding the printing medium in the conveyance direction, the to-be-cut position of the printing medium will be located on the conveyance belt except for a predetermined region including the groove. The control unit controls the feeding mechanism to begin feeding the printing medium at the timing calculated by the calculation unit. The control unit controls the conveyance mechanism and the cutting mechanism so that the cutting mechanism cuts the printing medium at the to-be-cut position thereof. After the cutting mechanism cuts the printing medium at the to-be-cut position thereof, the control unit controls the conveyance mechanism to convey the printing medium on the conveyance belt in the direction opposite to the conveyance direction.

According to the embodiments and examples of the invention, an inkjet printer ejects ink onto a printing medium stored in a rolled state to form an image and includes an ink reception groove to which ink will be ejected at the time of flushing in the conveyance belt. When the printing medium on which an image has been formed is cut and the storage portion-side printing medium is rewound, the front end of the printing medium is prevented from falling into the ink reception groove of the conveyance belt to thereby contaminate the printing medium with ink. Also, the printing medium is suitably prevented from separating from the conveyance belt to thereby touch an ink-jet head so as to be contaminated or to cause a failure in printing.

DETAILED DESCRIPTION OF THE PREFERRED EMBODIMENTS

Figure 1A:
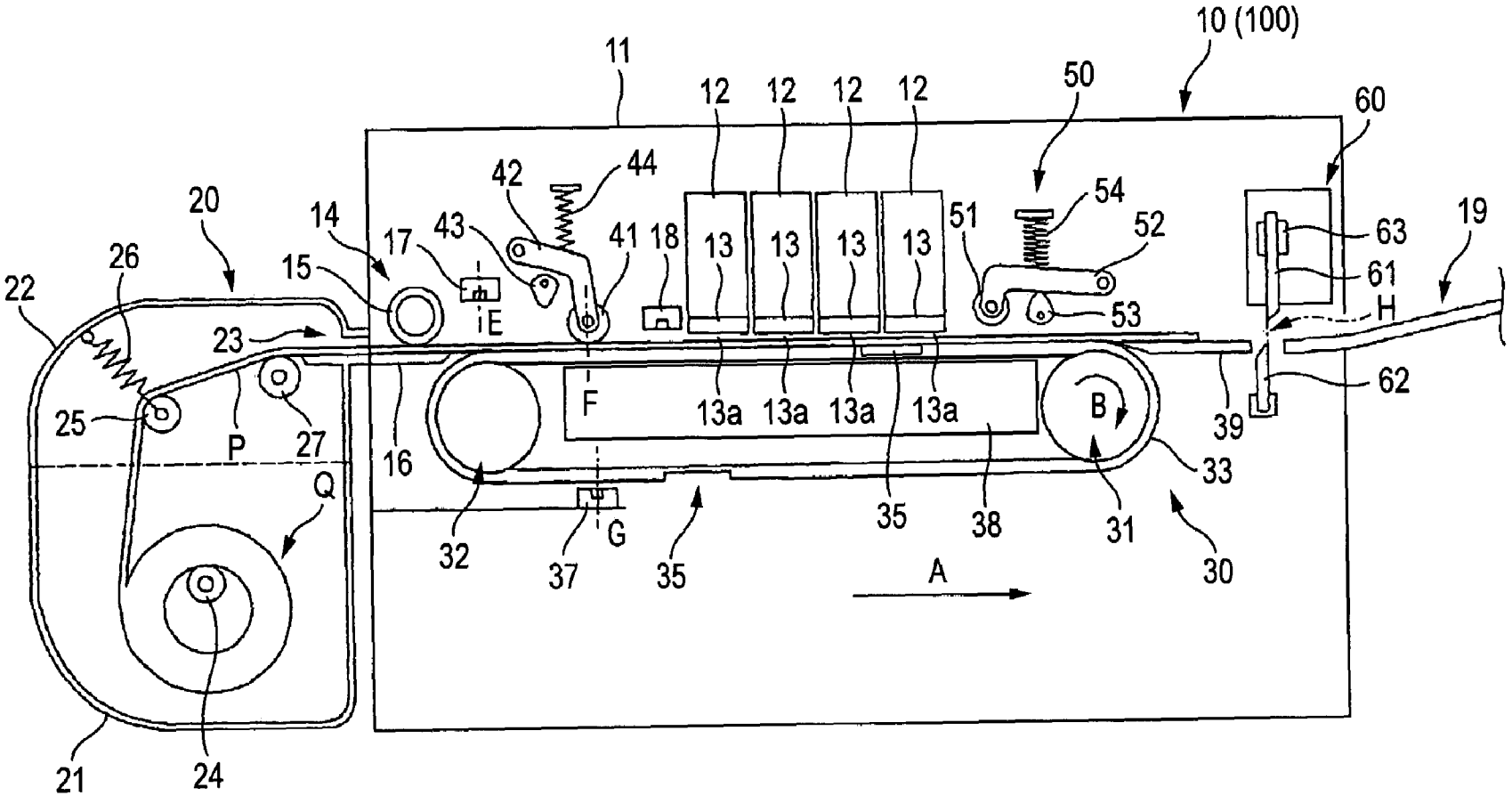
FIG. 1A is a side view showing the total configuration of an inkjet printer according to an embodiment of the invention.

Preferred embodiments of the invention will be described below.

An inkjet printer according to a first embodiment includes an inkjet head, a conveyance belt defining an ink reception groove on an outer circumferential surface thereof, a conveyance mechanism that drives the conveyance belt, a cutting mechanism that cuts the printing medium, a control unit, and a judgment unit.

In the inkjet printer according to the first embodiment configured thus, the printing medium is conveyed in the conveyance direction. The inkjet head ejects ink onto the printing medium to form an image thereon. Then, the control unit controls the cutting mechanism to cut the printing medium at a to-be-cut position, which is determined on the basis of the length of the image in order to extract, from the ink-jet printer, the portion of the printing medium where the image has been formed. The judgment unit judges whether or not the front end of the printing medium will be located in a predetermined region including the ink reception groove of the conveyance belt if the printing medium is rewound. It is judged, based on the judgment result of the judgment unit, that the cut position of the printing medium will be located in the predetermined region, the control unit controls the conveyance mechanism further conveys to convey the printing mechanism on the conveyance belt in the conveyance direction and then controls the cutting mechanism to cuts the printing medium again. When the judgment unit concludes that the cut position of the printing medium will not be located in the predetermined region of the conveyance belt, the control unit controls the conveyance mechanism to rewind the printing medium.

Due to the aforementioned configuration, in the ink-jet printer according to the first embodiment, there is no fear that, at the time of rewinding the printing medium, the front end of the printing medium is located in the ink reception groove so that the printing medium is contaminated with ink adhering to the ink reception groove.

An inkjet printer according to a second embodiment includes an inkjet head, a feeding mechanism that feeds the printing medium in a conveyance direction, a conveyance belt that defines on an outer circumferential surface thereof an ink reception groove, a conveyance mechanism that drives the conveyance belt, a cutting mechanism that cuts the printing medium, a control unit, a determination unit, and a calculation unit.

In the inkjet printer according to the second embodiment configured thus, at first the determination unit determines a to-be-cut position of the printing medium based on image data. It is preferable that the to-be-cut position is located upstream in the conveyance direction with respect to a region where an image will be formed. Then, the calculation unit calculates a timing at which if the feeding mechanism begins feeding the printing medium in the conveyance direction, the to-be-cut position of the printing medium will be located on the conveyance belt except for a predetermined region including the ink reception groove. The control unit controls the feeding mechanism to begin feeding the printing medium at the timing calculated by the calculation unit. After that, the conveyance belt conveys the printing medium fed from the feeding mechanism, and the inkjet head ejects ink onto the printing medium to form the image. The control unit controls the cutting mechanism to cut the printing medium at the to-be-cut position thereof. The control unit controls the conveyance mechanism to rewind the printing medium.

In the inkjet printer according to the second embodiment configured thus, the front end of the storage portion-side medium is prevented from being located in the ink reception groove when the storage portion-side medium is rewound. Thus, there is no fear that the printing medium is contaminated with ink adhering to the ink reception groove.

EXAMPLE 1

A preferred example of the invention will be described below with reference to the drawings. FIG. 1A is a side view showing the total configuration of an inkjet printer 10 according to this example.

The inkjet printer 10 shown in FIG. 1A is a line-printing-type color inkjet printer having four long inkjet heads 12. In a printer body 11 serving as a housing of the inkjet printer 10, a paper feed portion 14 (serving as a medium feed mechanism) having a paper feed roller 15 is provided on the left of FIG. 1A, and a discharge portion 19 is provided on the right of FIG. 1A, while a conveyance unit 30 (serving as a conveyance mechanism) having a conveyance belt 33 is provided in the central portion of FIG. 1A. Roll paper P as along printing medium stored like a roll in a roll paper cassette 20 (serving as a storage portion) is conveyed to pass under the inkjet heads 12 for forming an image thereon. Incidentally, the direction running from the roll paper cassette 20 toward the inkjet heads 12 will be referred to as a medium feed direction (an arrow A direction in FIG. 1A).

(Image Forming Mechanism) The inkjet heads 12 have head bodies 13 in their lower ends, respectively. Each head body 13 has a flow path unit and an actuator unit pasted together. Ink flow paths including pressure chambers are formed in the flow path unit, and the actuator unit is to apply pressure to ink in each pressure chamber. In addition, the head bodies 13 have rectangular sections, respectively, and are disposed closely to each other so that their longitudinal directions are perpendicular to the medium feed direction of the paper (perpendicular to the paper of FIG. 1A). The bottom surfaces (ejection surfaces 13*a*) of the head bodies 13 are opposed to the paper conveyance path. A large number of ejection holes having very small diameters corresponding to nozzles respectively are provided in the ejection surfaces 13*a*. Inks of magenta (M), yellow (Y), cyan (C) and black (K) are ejected from the four head bodies 13, respectively.

The head body 13 is disposed to form a slight gap between the bottom thereof and the conveyance belt 33. The paper conveyance path is formed in this gap. With this configuration, the inks of the respective colors are ejected from the ink ejection holes onto the upper surface (printing surface) of the roll paper P when the roll paper P carried on the conveyance belt 33 passes just under the four head bodies 13 in turn. Thus, a desired color image is formed on the paper.

(Configuration of Roll Paper Cassette) Next, description will be made on the configuration of the roll paper cassette 20, which stores the roll paper P serving as a printing medium to be used in the inkjet printer 10.

As shown in FIG. 1A, the roll paper cassette 20 is detachably disposed at a position opposed to the paper feed portion 14 and on the upstream side of the printer body 11 in the medium feed direction. The roll paper cassette 20 is constituted by a lower box 21 and an upper box 22, which can be split vertically. A feed port 23 serving as an exit for feeding the roll paper P to the paper feed portion 14 is provided in the upper box 22. The roll paper cassette 20 is attached to the printer body 11 and fixed thereto by a not-shown fixing member so that a portion of the feed port 23 protruding outward from the roll paper cassette 20 is opposed to the paper feed portion 14.

Two support rollers 24 are provided in the lower body 21 so as to extend in parallel to a direction (hereinafter referred to as a "printer width direction") perpendicular to the medium feed direction and perpendicular to the paper of FIG. 1A. The support rollers 24 rotatably support paper roll Q from the inside of its roll-like shape. The paper roll Q designates the roll paper P wound like a roll. The support rollers 24 are inserted into a hollow portion of the paper roll Q and supported rotatably and removably at both ends of the lower box 21 in the printer width direction.

The upper box 22 includes the feed port 23, an urging roller 25, a spring 26 for supporting the urging roller 25 rotatably and elastically, and a guide roller 27 for rotating the roll paper P so as to guide it to the feed port 23. The guide roller 27 is rotatably supported at its both ends by the upper box 22 on the upstream side of the feed port 23 in the medium feed direction.

The urging roller 25 supported on the spring 26 has an operation of absorbing an impact acting on the roll paper P at the beginning of rotation of the paper roll Q for starting to convey the roll paper P. When a printing operation is initiated to drive the paper feed roller 15 (to rotate the paper feed roller 15 in a direction to convey the roll paper P in the medium feed direction), the paper roll Q begins to rotate. In this event, large impact is instantaneously applied to the roll paper P due to the inertial force on the rotation of the paper roll Q. In this event, there is a fear that the paper roll Q may rattle unstably, or that a paper feed motor 79 (see FIG. 4) giving a driving force to the paper feed roller 15 may be locked due to a sudden change in tension acting on the roll paper P. The paper feed motor 79 will be described later. In addition, there is a fear that printing misalignment may occur due to an instantaneous stop of the conveyance of the roll paper P caused by the impact, or that the roll paper P in close contact with the conveyance belt 33 maybe separated from the conveyance belt 33. However, the urging roller 25 moves while rotating and giving moderate tension to the roll paper P due to the spring 26, so that the urging roller 25 can absorb the impact generated in the roll paper P.

Figure 2:
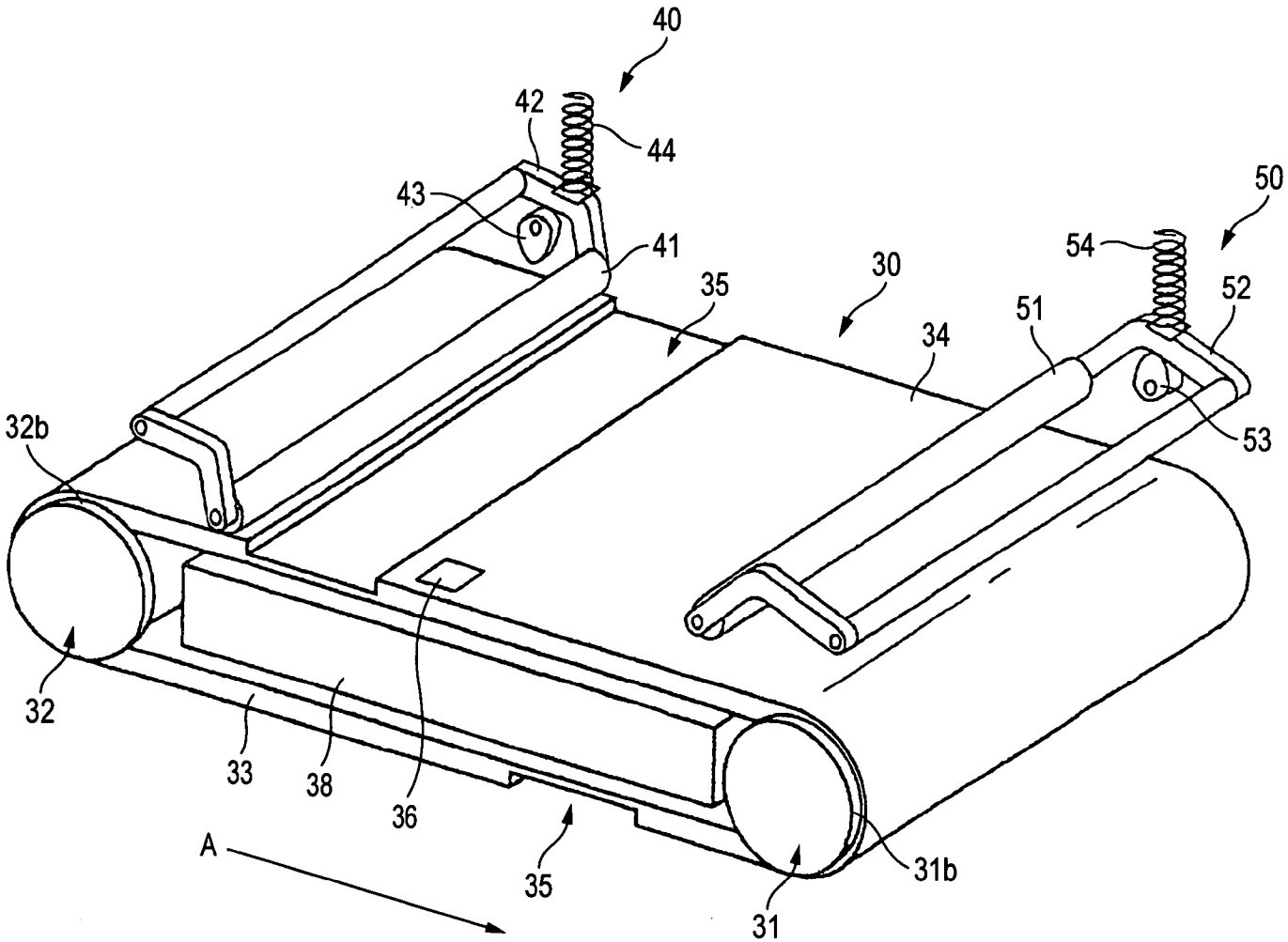
FIG. 2 is a perspective view showing the schematic configuration of a conveyance system.

(Medium Feed Mechanism) Next, description will be made on the configuration of the conveyance system of the inkjet printer 10 with reference to FIGS. 1A and 2. FIG. 2 is a perspective view showing the schematic configuration of the conveyance system.

As shown in FIG. 1A, the paper feed portion 14 for feeding the roll paper P taken out from the roll paper cassette 20 to the conveyance unit 30 which will be described later is constituted by a paper feed roller 15, a paper feed base 16 and a guide wall (not shown). The roll paper P is pressed and held between the paper feed base 16 and the paper feed roller 15. The guide wall is provided in parallel to the medium feed direction. Aside end of the roll paper P is made to abut against the guide wall so as to prevent the roll paper P from slanting. The paper feed roller 15 is rotatably supported at its both ends, and connected at its one end to a paper feed motor 79 (see FIG. 3). The paper feed roller 15 presses and holds the roll paper P on the top of the paper feed base 16, and feeds the roll paper P in the medium feed direction by means of driving of the paper feed motor 79. In addition, the paper feed roller 15 is disposed so that its rotation axis tilts at an angle of three degrees with respect to the medium feed direction. Accordingly, when the paper feed roller 15 is driven to convey the roll paper P, the roll paper P is fed toward the conveyance unit 30, and forcibly made to approach the not-shown guide wall before a paper front end D (see FIG. 6), which is the downstream end of the roll paper P in the medium feed direction, reaches the conveyance unit 30. Thus, a width-direction end portion of the roll paper P abuts against the guide wall so that the roll paper P is aligned in parallel to the medium feed direction. Incidentally, when the paper feed motor 79 rotates forward, the paper feed roller 15 rotates in a direction to feed the roll paper P downstream in the medium feed direction. On the contrary, when the paper feed motor 79 rotates backward, the paper feed roller 15 rotates in a direction to rewind the roll paper P upstream in the medium feed direction. The paper feed motor 79 is a stepping motor, which rotates forward by one step in response to a pulse of a positive voltage signal applied thereto, and rotates backward by one step in response to a pulse of a negative voltage signal applied thereto.

(Paper Sensor) First and second paper sensors 17 and 18, which are photo-sensors for detecting the paper front end D of the roll paper P on the downstream side in the medium feed direction, are provided in the inkjet printer 10 as shown in FIG. 1A. The first paper sensor 17 is provided between the paper feed roller 15 and the position where the conveyance belt 33 is disposed. The second paper sensor 18 is disposed on the upstream side of the inkjet heads 12 in the medium feed direction. Each paper sensor is disposed to be opposed to the conveyance belt 33.

The first paper sensor 17 is used for stopping the paper front end D of the roll paper P in an initial position E (in this example, a position where the paper front end D is opposed to the first paper sensor 17, see FIG. 1A) set between the conveyance unit 30 and the first close contact mechanism 40 when the roll paper P is fed out to the conveyance belt 33. In the inkjet printer 10 according to this example, ink reception grooves 35 for receiving ink at the time of flushing are provided in the conveyance belt 33. Accordingly, when the roll paper P is fed out by the paper feed roller 15, there is a fear that the paper front end D may be located in one of the ink reception grooves 35. Therefore, the paper front end D is stopped in the initial position E by the first paper sensor 17, and the paper feed roller 15 is rotated at the timing with which the paper front end D will not be located in any ink reception groove 35 as will be described later. Thus, the paper front end D can be prevented from being located in any ink reception groove 35, so that the ink adhering to the inside of the ink reception groove 35 can be prevented from being transferred to the roll paper P.

The second paper sensor 18 is used for determining the start timing of image formation by the inkjet head 12. Incidentally, each of the first and second paper sensors 17 and 18 is an optical sensor constituted by a light emitting device and a light receiving device, which detect the paper front end D by detecting the intensity of reflected light generated from a difference in reflectance between the roll paper P and the conveyance belt 33.

(Conveyance Unit) Next, the configuration of the conveyance unit 30 will be described with reference to FIGS. 1A and 2.

As shown in FIG. 1A, the conveyance unit 30 includes two belt rollers 31 and 32, and an endless conveyance belt 33 laid between the two rollers 31 and 32. The conveyance unit 30 is disposed under the ink ejection surfaces 13*a* of the inkjet heads 12 at a predetermined distance therefrom.

As shown in FIG. 2, each of the two belt rollers 31 and 32 is constituted by a cylindrical body and flange portions 31*b*, 32*b*. The cylindrical body has a cylindrical shape in contact with the inner circumferential surface of the conveyance belt 33. The flange portions 31*b*, 32*b* are provided in both end portions of the cylindrical body. Each flange portion 31*b*, 32*b* has a radius substantially as large as a radius corresponding to the total value of the thickness of the conveyance belt 33 and the radius of the cylindrical body. The belt rollers 31 and 32 are rotatably supported by not-shown rotation shafts provided in the flange portions 31*b* and 32*b*, respectively. Of the two belt rollers 31 and 32 of the conveyance unit 30, the belt roller 31 located on the downstream side of the paper conveyance path is connected to a conveyance motor 77 (see FIG. 3), and the rotation and driving of the conveyance motor 77 is controlled by a control portion 70, which will be described later. On the other hand, the belt roller 32 located upstream is a driven roller rotated by the torque applied to the conveyance belt 33 by the rotation of the belt roller 31.

When the conveyance motor 77 rotates forward, the conveyance belt 33 moves (rotates forward) in a direction to convey the roll paper P downstream in the medium feed direction. When the conveyance motor 77 rotates backward, the conveyance belt 33 moves (rotates backward) in a direction to convey the roll paper P upstream in the medium feed direction. Incidentally, the conveyance motor 77 is a stepping motor rotating forward by one step in response to a pulse of a positive voltage signal applied thereto and rotating backward by one step in response to a pulse of a negative voltage signal applied thereto.

The conveyance belt 33 is an endless loop-like belt having elasticity. The material of the conveyance belt 33 is not limited especially. For example, silicon rubber, EPDM, urethane rubber, butyl rubber or the like may be used. Treatment with adhesive silicon rubber is performed on a surface (hereinafter referred to as "conveyance surface") 34 of the conveyance belt 33, which will be brought into contact with the roll paper P. Accordingly, the conveyance unit 30 can convey the roll paper P carried thereon, in the medium feed direction and in an opposite direction thereto by the rotation and driving of one belt roller 31 of the conveyance unit 30 while holding the roll paper P on the conveyance surface 34 of the conveyance belt 33 due to its adhesive force. The roll paper P, which has been wound and stored like a roll in the roll paper cassette 20, has a tendency of curling. However, since the roll paper P is conveyed on the conveyance surface 34 while being held thereon due to the adhesive force, the roll paper P is prevented from being separated therefrom due to the tendency of curling. Therefore, when the roll paper P is conveyed, the roll paper P is prevented from touching the ejection surfaces 13*a* of the inkjet heads 12 and allowing ink to adhere to the roll paper P.

Independently of the operation of image formation, the inkjet printer 10 performs an operation of flushing for ejecting ink from the ejection holes onto the conveyance belt 33 so as to remove thickened ink droplets or foreign matters from the head body 13. To this end, the ink reception grooves 35 for receiving the ink in the flushing operation are provided in two places of the outer circumferential surface of the conveyance belt 33. The ink reception grooves 35 extend all over the width of the conveyance belt 33 and in parallel with a direction (printer width direction) crossing the medium feed direction. Incidentally, the two ink reception grooves 35 are provided at an equal interval on the conveyance belt 33.

A marker 36 (serving as a member to be detected) having a light reflectance different from that of the conveyance surface is provided in the conveyance surface 34 of the conveyance belt 33 and at a predetermined distance from each ink reception groove 35. Incidentally, in this example, the position where the marker 36 is disposed is regarded as an origin on the conveyance belt 33 set at a predetermined position with respect to the ink reception groove 35. In addition, in order to detect the marker 36, an origin detection sensor 37 (see FIG. 1A) is provided under the conveyance belt 33 and at a position close to the belt roller 32 so as to be opposed to the outer circumferential surface of the conveyance belt 33. The origin detection sensor 37 is a photo-sensor for detecting the marker 36 (origin) based on a change in intensity of reflected light due to the marker 36.

In addition, in a region surrounded by the conveyance belt 33, a guide member 38 having a substantially rectangular parallelepiped shape is disposed in contact with the inner circumferential surface of the conveyance belt 33 on its top side so as to support the conveyance belt 33. The guide member 38 is formed to have a width substantially equal to that of the conveyance belt 33.

(Release Mechanism) As shown in FIG. 1A, a release plate 39 is provided on the downstream side of the conveyance belt 33 in the medium feed direction. The release plate 39 is designed to release the roll paper P adhering to the conveyance surface 34 of the conveyance belt 33, from the conveyance surface 34. (First Close Contact Mechanism) Next, description will be made on the first close contact mechanism 40 for bringing the roll paper P fed out from the paper feed portion 14, into close contact with the conveyance surface 34 of the conveyance belt 33. The first close contact mechanism 40 is constituted by a first pressure roller 41, a first arm 42, a cam 43 and a spring 44.

In the first close contact mechanism 40, the cam 43 is driven by a first drive motor 83 (see FIG. 3) so that the cam 43 comes into contact with the lower surface of the first arm 42 and lifts up the first arm 42. When the cam 43 keeps rotating further in this state, the cam 43 leaves the first arm 42 so that the first arm 42 is urged downward by the spring 44 and the first pressure roller 41 presses the roll paper P onto the conveyance belt 33. In such a manner, the first close contact mechanism 40 can bring the roll paper P into close contact with the conveyance belt 33.

(Second Close Contact Mechanism) Next, description will be made on the second close contact mechanism 50 for bringing the roll paper P released by the release plate 39, into close contact with the conveyance surface 34 of the conveyance belt 33 again in the rewinding operation for conveying the roll paper P in the opposite direction to the medium feed direction. The second close contact mechanism 50 is constituted by a second pressure roller 51, a second arm 52, a cam 53 and a spring 54.

In the second close contact mechanism 50, the cam 53 is driven by a second drive motor 85 (see FIG. 3) so that the cam 53 comes into contact with the lower surface of the second arm 52 and lifts up the second arm 52. When the cam 53 keeps rotating further in this state, the cam 53 leaves the second arm 52 so that the second arm 52 is urged downward by the spring 54 and the second pressure roller 51 presses the roll paper P onto the conveyance belt 33. In such a manner, the second close contact mechanism 50 can bring the roll paper pin to close contact with the conveyance belt 33 again in the rewinding operation. (Cutting Mechanism) Next, description will be made on the cutting mechanism 60 for cutting the roll paper P upstream in the medium feed direction with respect to the region where an image is formed after the inkjet head 12 forms the image and the roll paper P having the image formed thereon is fed out to the discharge portion 19.

Figure 3:
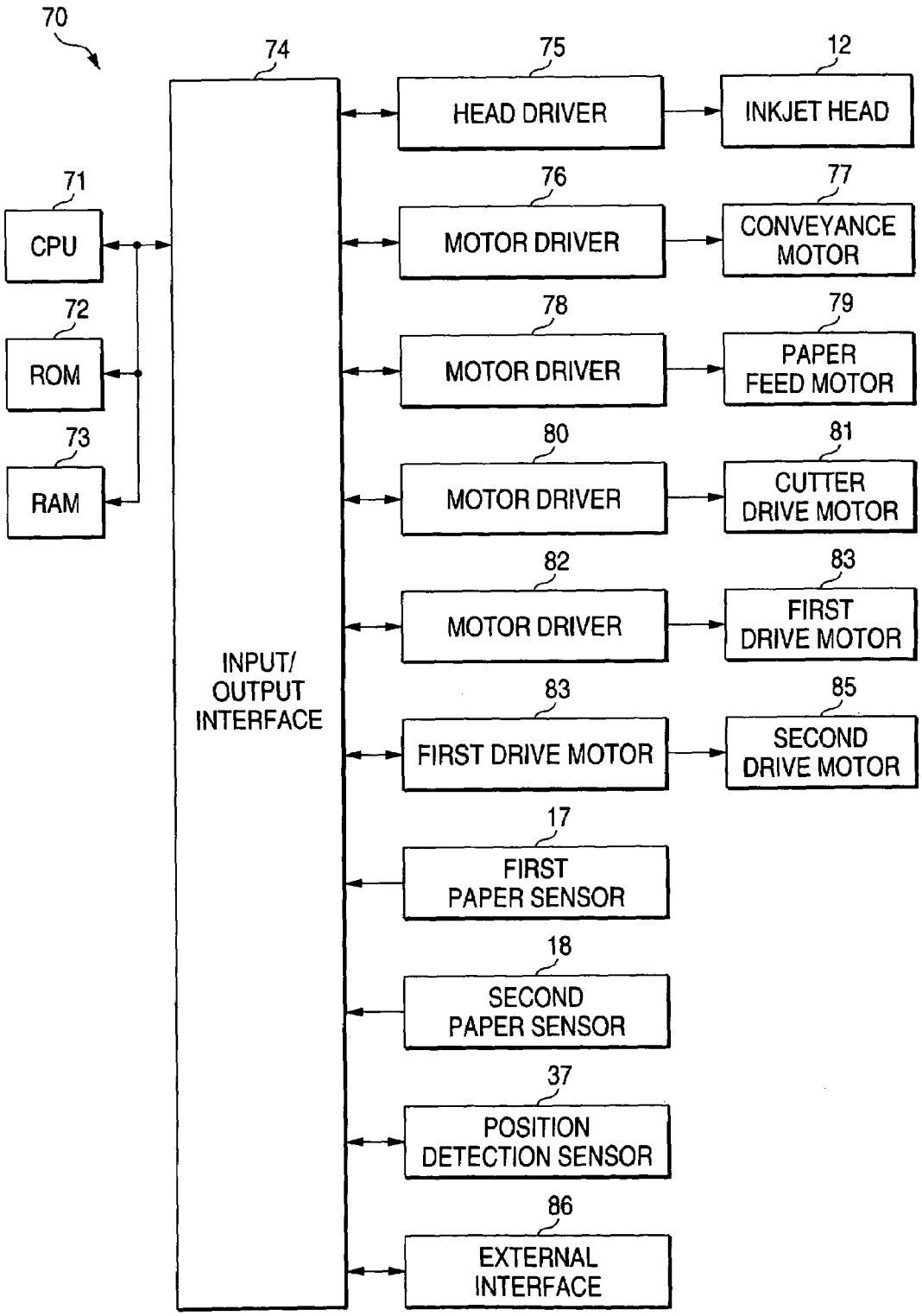
FIG. 3 is a schematic block diagram showing the configuration of a control system of the inkjet printer.

As shown in FIG. 1A, the cutting mechanism 60 is constituted by a movable blade 61, a fixed blade 62, and an actuator 63 moving up and down while supporting the movable blade 61. The movable blade 61 is a blade-like member whose lower end portion is wider than the roll paper P and which has a blade surface inclined with respect to the horizontal direction. The movable blade 61 is fixed to the actuator 63 so that the blade surface looks downward. On the other hand, the fixed blade 62 has the same width as the movable blade 61, and the blade surface of the fixed blade 62 is formed horizontally. The fixed blade 62 is fixed in the opening portion formed in the conveyance path under the movable blade 61 so that the blade surface of the fixed blade 62 does not project on the conveyance path. In such a configuration, the actuator 63 to which the movable blade 61 is fixed is driven by a cutter drive motor 81 (see FIG. 3) so as to move up and down. Thus, the roll paper P is cut at the position where the movable blade 61 and the fixed blade 62 overlap each other. The timing of the cutting operation with the actuator 63 is controlled by the control portion 70 which will be described later. The roll paper P is cut by the cutting mechanism 60 configured thus. The roll paper P where the image has been formed can be taken out from the discharge portion 19. Incidentally, the cutting mechanism 60 is not limited to the aforementioned configuration. For example, the cutting mechanism 60 may be a so-called rotary cutter for cutting the roll paper P while rotating. (Configuration of Control System) Next, the configuration of the control portion 70 of the inkjet printer 10 will be described with reference to FIG. 3. FIG. 3 is a schematic block diagram showing the configuration of the control system of the ink-jet printer 10.

The control portion 70 of the inkjet printer 10 includes a CPU 71, which is a central processing unit, a ROM 72 for storing programs and data to be used for control by the CPU 71, and a RAM 73, which is a temporary storage memory.

The CPU 71, the ROM 72 and the RAM 73 are connected to an input/output interface 74 through a data bus. In addition, a head driver 75 for driving the inkjet heads 12, a motor driver 76 for driving the conveyance motor 77, a motor driver 78 for driving the paper feed motor 79, a motor driver 80 for driving the cutter drive motor 81, a motor driver 82 for driving the first drive motor 83, a motor driver 84 for driving the second drive motor 85, the first paper sensor 17, the second paper sensor 18, the origin detection sensor 37, and an external interface 86 for making communication for various external data such as image data, are connected to the input/output interface 74. These various drivers and sensors can input/output signals from/to the control portion 70 through the input/output interface 74.

(Printing Operation)

Figure 4:
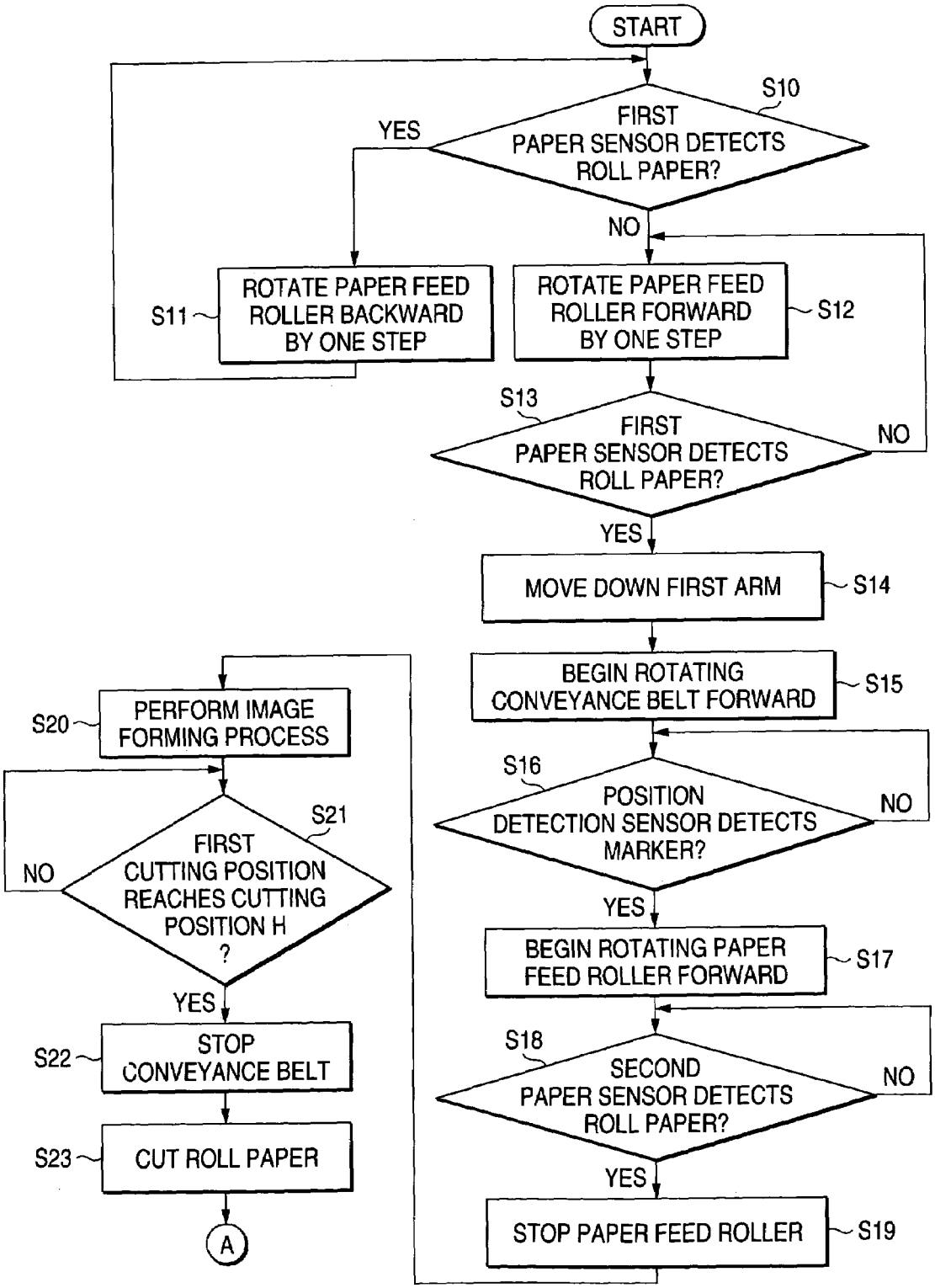
FIG. 4 is an operation flow chart showing the outline of a printing operation in Embodiment 1.
Figure 5:
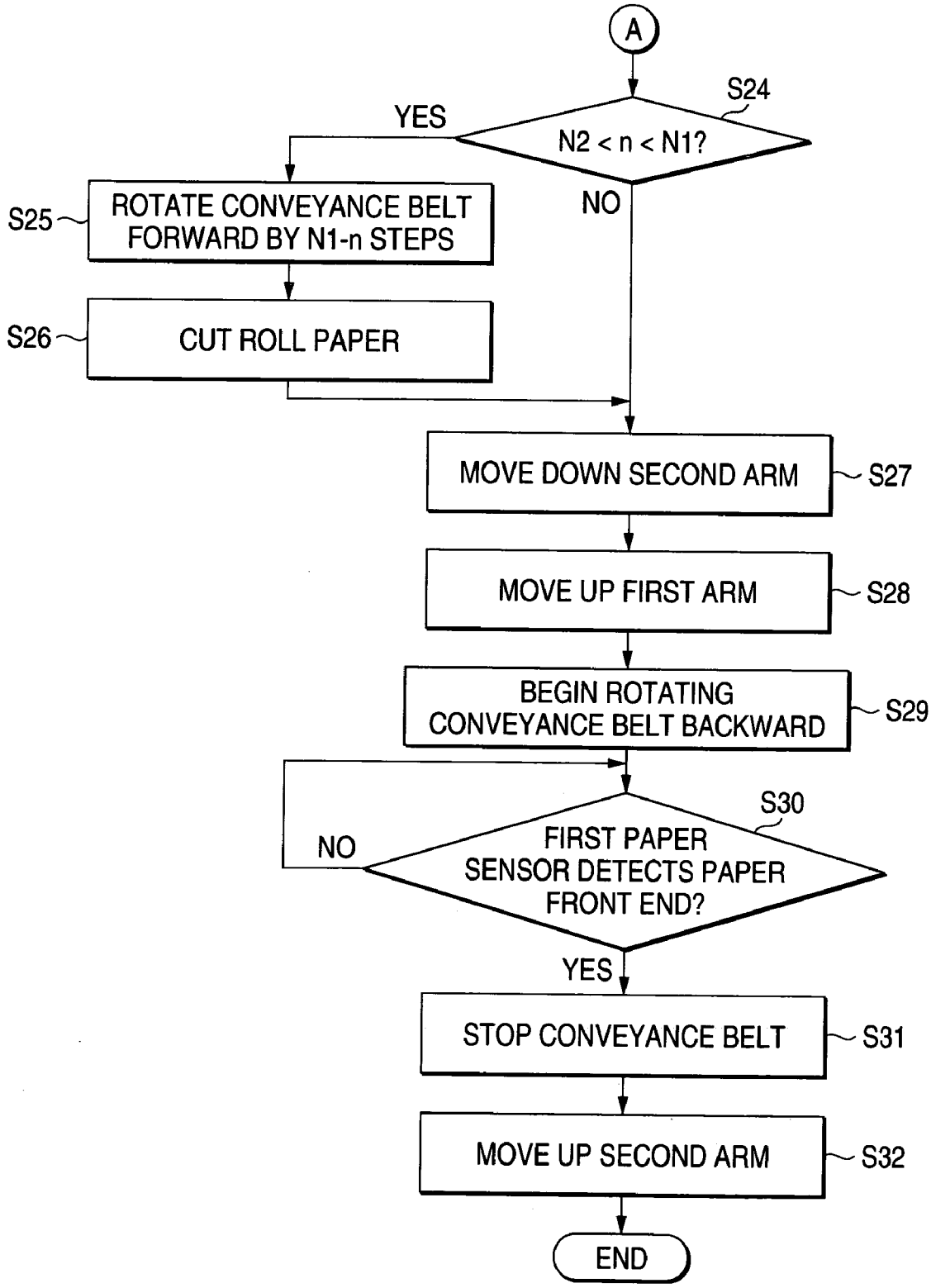
FIG. 5 is an operation flow chart showing the outline of the printing operation in Embodiment 1.
Figure 6:
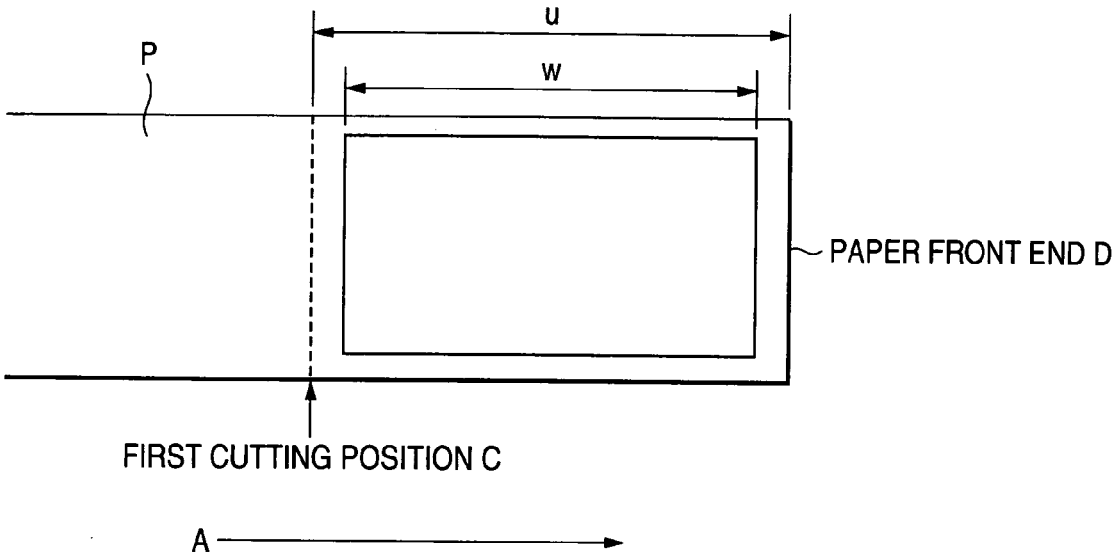
FIG. 6 is a view showing the state of roll paper P in which an image has been formed.
Figure 7A:
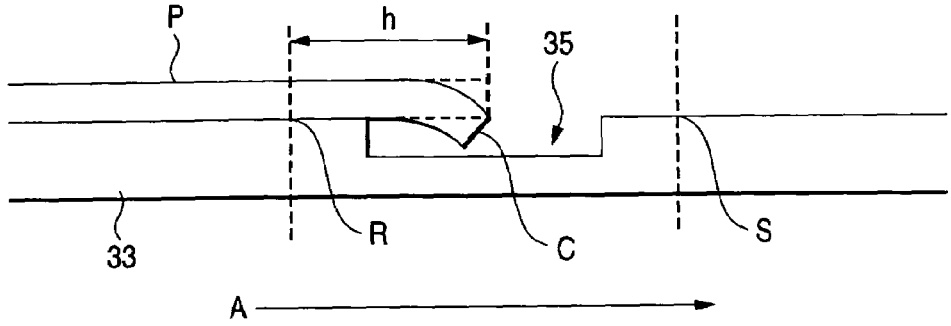
FIGS. 7A to 7C are explanatory views showing the circumstances of the periphery of a first cutting position observed from the width direction of a conveyance belt.
Figure 7B:
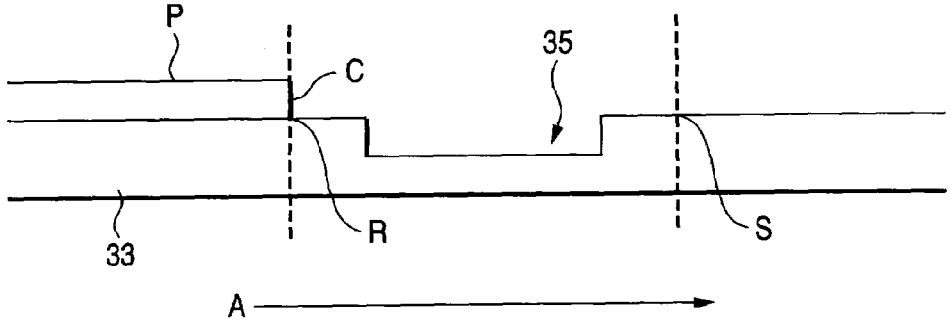
Figure 7C:
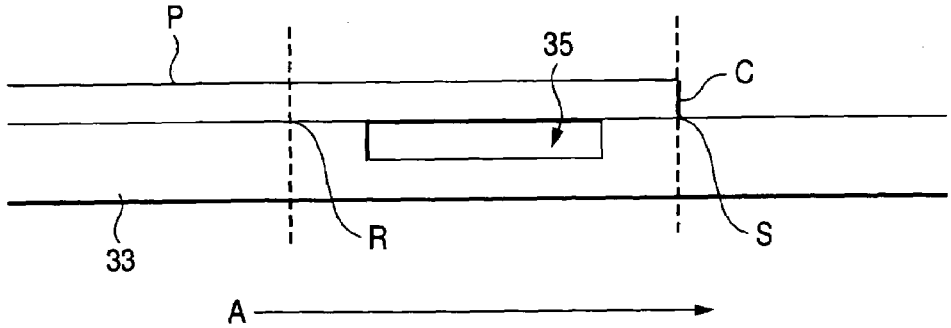

The printing operation to be executed by the inkjet printer 10 configured thus will be described with reference to FIGS. 4 to 6 and FIGS. 7A to 7C. FIGS. 4 and 5 are operation flow charts schematically showing the printing operation in the inkjet printer 10. FIG. 6 is a view showing the state of the roll paper P on which an image has been formed. FIGS. 7A to 7C are explanatory views showing the circumstances of the periphery of a first cutting position C observed in the width direction of the conveyance belt 33 when the roll paper P is cut at the first cutting position C, and the conveyance belt 33 is then rotated backward to rewind the storage portion-side roll paper as it is, as will be described later. The first cutting position C is set as a position at which the roll paper P will be cut after the image is formed and which is located upstream in the medium feed direction with respect to the region where an image is formed on the roll paper P. When there are a plurality of images, the first cutting position C means a position where the roll paper P will be finally cut upstream in the medium feed direction with respect to the region where the last image is formed. Incidentally, it is assumed that before executing the printing operation, which will be described later, the CPU 71 in advance generates print data including data as to the timing with which ink will be ejected from each inkjet head 12, data as to the timing with which the roll paper P will be cut at the first cutting position C, and the like on the basis of a print instruction signal received through the external interface 86. In addition, it is assumed that the roll paper P is set beforehand at a position where the roll paper P is in contact with the paper feed roller 15.

When the printing operation is initiated, first the CPU 71 controls the paper feed roller 15 to move the roll paper P so that the paper front end D of the roll paper P is located at the initial position E. In Step S10 (hereinafter expressed by only "S10". The same thing will be applied to any other step,)

shown in FIG. 4, the CPU 71 judges whether or not the first paper sensor 17 detects the roll paper P. When the first paper sensor 17 detects the roll paper P (S10: YES), the paper front end D of the roll paper P is located on the conveyance belt 33 side with respect to the initial position E. Accordingly, the CPU 71 rotates the paper feed roller 15 backward by one step (rotates the paper feed motor 79 by one step. The same thing will be applied to the following cases.) (Step 11), and makes a judgment in S10 again as to whether or not the first paper sensor 17 detects the roll paper P. The CPU 71 repeats the processings of S10–S11 till the roll paper P is not detected.

When the roll paper P is not detected in S10 (S10: NO), the paper front end D of the roll paper P is located on the paper feed roller 15 side with respect to the initial position E. Accordingly, the CPU 71 rotates the paper feed roller 15 forward by one step (S12). After that, the CPU 71 judges whether or not the first paper sensor 17 detects the roll paper P. When the roll paper P is not detected (S13: NO), the paper front end D is regarded as still located on the paper feed roller 15 side with respect to the initial position E. Thus, the CPU 71 returns to the processing of S12. On the contrary, when the first paper sensor 17 detects the roll paper P (S13: YES), the paper front end D of the roll paper P is regarded as located at the initial position E. Thus, the CPU 71 advances to the processing of S14.

In S14, the CPU 71 moves down the first arm 42 so that the pressure roller 41 of the first close contact mechanism 40 is located at a position (first close contact position F, see FIG. 1A) where the pressure roller 41 presses the conveyance belt 33. When the first arm 42 is moved down in advance before the roll paper P is fed out by the paper feed roller 15, the roll paper P can be brought into close contact with the conveyance belt 33 from the paper front end D of the roll paper P.

Figure 1B:
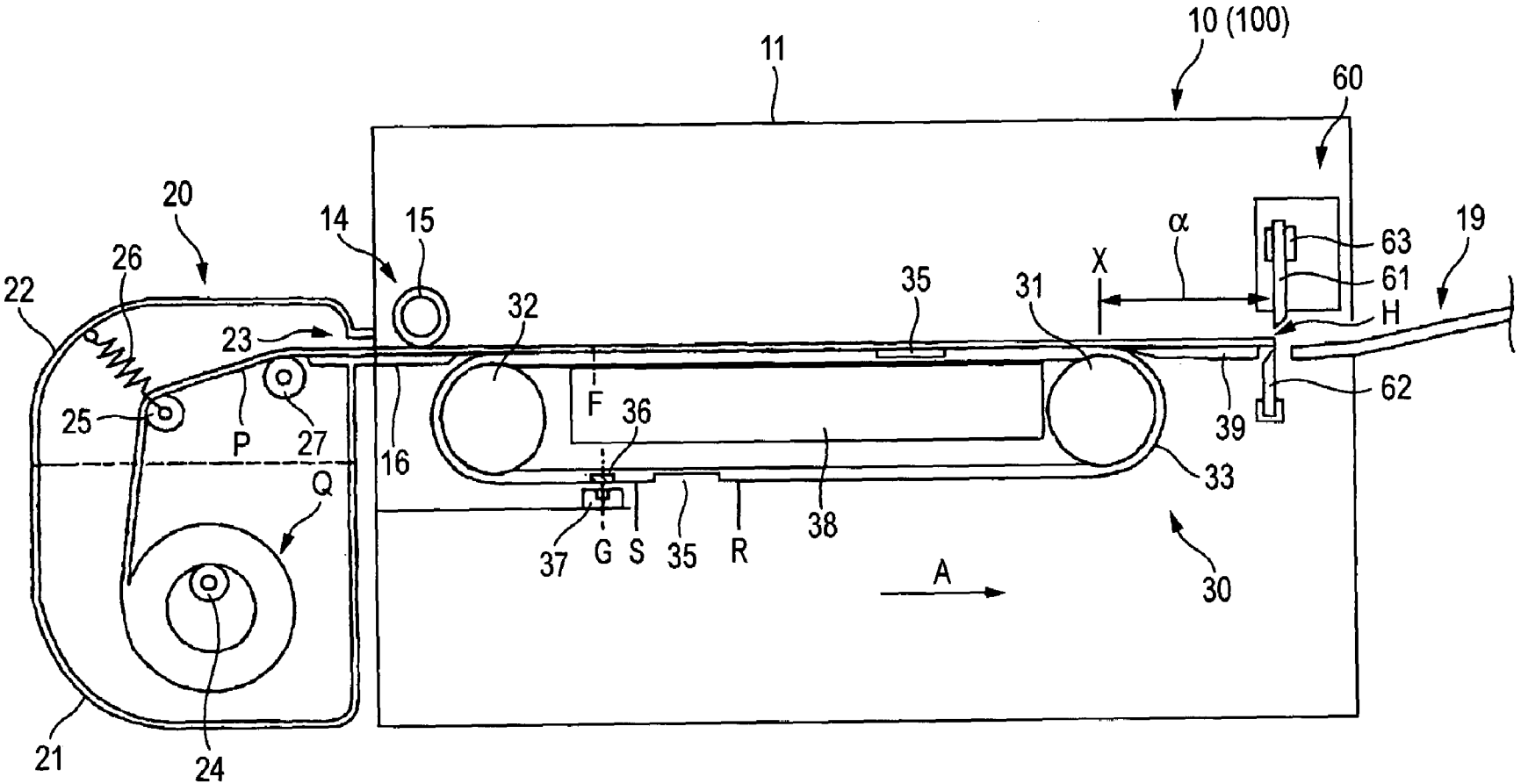
FIG. 1B shows a state where a marker 36 is located at a detection position G and a detection sensor 37 detects the marker 36.

After the first arm 42 moves down, the CPU 71 gives an instruction to the conveyance motor 77 so that the conveyance belt 33 begins to rotate forward (S15). After that, the CPU 71 monitors a detection signal of the origin detection sensor 37 as to whether the marker 36 provided in the conveyance belt 33 has passed a position (detection position G) faces the origin detection sensor 37 or not (S16). FIG. 1B shows a state where the marker 36 is located at the detection position G and the detection sensor 37 detects the marker 36. In this example, when the marker 36 faces the origin detection sensor 37 as shown in FIG. 1B, the ink reception groove 35 is located in a predetermined position. In this event, the CPU 71 resets the rotation step number n of the conveyance motor 77 stored in the RAM 73 to be "0". Based on the rotation step number n of the conveyance motor 77, the CPU 71 calculates the traveling distance of the conveyance belt 33 after the ink reception groove 35 is located at the predetermined position. Thus, the CPU 71 can determine the position where the ink reception groove 35 is located.

When the origin detection sensor 37 detects the marker 36 in S16 (S16: YES), the CPU 71 rotates the paper feed motor 79 forward (S17). When the paper feed motor 79 begins to rotate forward (begins paper feeding), the roll paper P is fed out from the roll paper cassette 20 by the paper feed roller 15 so that the paper front end D of the roll paper P is fed onto the conveyance belt 33. This example is designed as follows. That is, when the origin detection sensor 37 detects the marker 36, the paper feed motor 79 is rotated forward so as to prevent the paper front end D of the roll paper P from being located in any ink reception groove 35. However, the timing with which the paper feed motor 79 is rotated forward may be changed suitably in accordance with the convenience of the design. As soon as paper feeding is started, the CPU 71 begins monitoring the second paper sensor 18 as to whether or not the second paper sensor 18 detects the roll paper P.

The roll paper P fed out by the paper feed roller 15 reaches the first close contact position F while facing the conveyance belt 33. When the roll paper P reaches the first close contact position F, the first pressure roller 41 presses the roll paper P onto the conveyance belt 33 to bring the paper P into close contact with the conveyance belt 33.

When the roll paper P carried on the conveyance belt 33 is conveyed in the medium feed direction, the second paper sensor 18 detects the roll paper P (S18: YES), and the CPU 71 stops the paper feed roller 15 (S19). As soon as the roll paper P moves a predetermined distance on the conveyance belt 33 after the second paper sensor 18 detects the paper front end D of the roll paper P, the CPU 71 drives the inkjet heads 12 based on the print data so as to form an image while conveying the roll paper P (S20).

After the image formation process by the inkjet heads 12 is terminated, the CPU 71 monitors the first cutting position C as to whether the first cutting position C reaches a position (cutting position H, see FIG. 1A) where the roll paper P will or not be cut by the cutting mechanism 60, in order to discharge the image-formed region of the roll paper P to the discharge portion 19 (S21). As shown in FIG. 6, the image has been formed on the roll paper P with a blank being provided over a predetermined width from the paper front end D of the roll paper P. Accordingly, the first cutting position C is a position further having a blank of a predetermined width from the region where the image has been formed. The CPU 71 calculates a distance which the first cutting position C of the roll paper P moves from a time when the image formation is terminated to a time when the first cutting position C reaches the cutting position H, based on a distance u between the paper front end D and the first cutting position C.

When the paper front end D of the roll paper P reaches the position where the release plate 39 is disposed, the roll paper P is released from the conveyance belt 33 by the release plate 39, and fed out to the cutting position H as it is. When the first cutting position C is conveyed to the cutting position H (S21: YES), the conveyance belt 33 stops (S22), and the roll paper P is cut in the first cutting position C (S23).

After the roll paper P is cut at the first cutting position C, the roll paper (storage portion-side medium, which will be hereinafter referred to as "storage portion-side roll paper") on the roll paper cassette 20 side with respect to the first cutting position C is rewound in an opposite direction to the medium feed direction by the backward rotation of the conveyance motor 77. However, during the rewinding operation, the first cutting position C may be located in the ink reception groove 35 of the conveyance belt 33. Therefore, before performing the rewinding operation, the CPU 71 judges whether or not the first cutting position C of the storage portion-side roll paper will be located in a predetermined region RS (see FIG. 7A) including the ink reception groove 35 of the conveyance belt 33 during the rewinding operation (S24). When the first cutting position C is expected to be located in the predetermined region RS, the storage portion-side roll paper is fed downstream in the medium feed direction by a predetermined distance, and the storage portion-side roll paper is cut again. After this cutting operation (hereinafter referred to as "second cutting operation") is performed, the rewinding operation is performed.

As shown in FIG. 7A, when the first cutting position C is located in the ink reception groove 35 in the rewinding operation, the first cutting position C falls into the ink reception groove 35 due to its curling tendency. As a result, ink adhering to the inside of the ink reception groove 35 might be transferred to the roll paper P. Accordingly, in the ink-jet printer 10 according to this example, it is determined before the rewinding operation is started whether or not the roll paper P will be located in the predetermined region RS (the region between a border R and a border S shown in FIG. 7A) when the rewinding operation is performed after the roll paper P is cut at the first cutting position C in S23. The predetermined region RS includes a region where the ink reception groove 35 is formed and a region adjacent to the ink reception groove 35 in the medium feed direction and having a predetermined width. When the first cutting position C is located in the region just adjacent to the ink reception groove 35, the front end of the roll paper P may fall into the ink reception groove 35 due to an error in conveyance of the conveyance belt 33 or the like. When the first cutting position C is located in the downstream vicinity of the ink reception groove 35 in the medium feed direction at the time of the rewinding operation, the rewound storage portion-side roll paper may fall into the ink reception groove 35 due to its curling tendency before the storage portion-side roll paper is brought into close contact with the conveyance surface 34 of the conveyance belt 33. Accordingly, the second cutting operation is executed when the first cutting position C is located in the predetermined region RS including the region between the region where the ink reception groove 35 is formed and the border R and the region between the region where the ink reception groove 35 is formed and the border S.

Figure 1C:
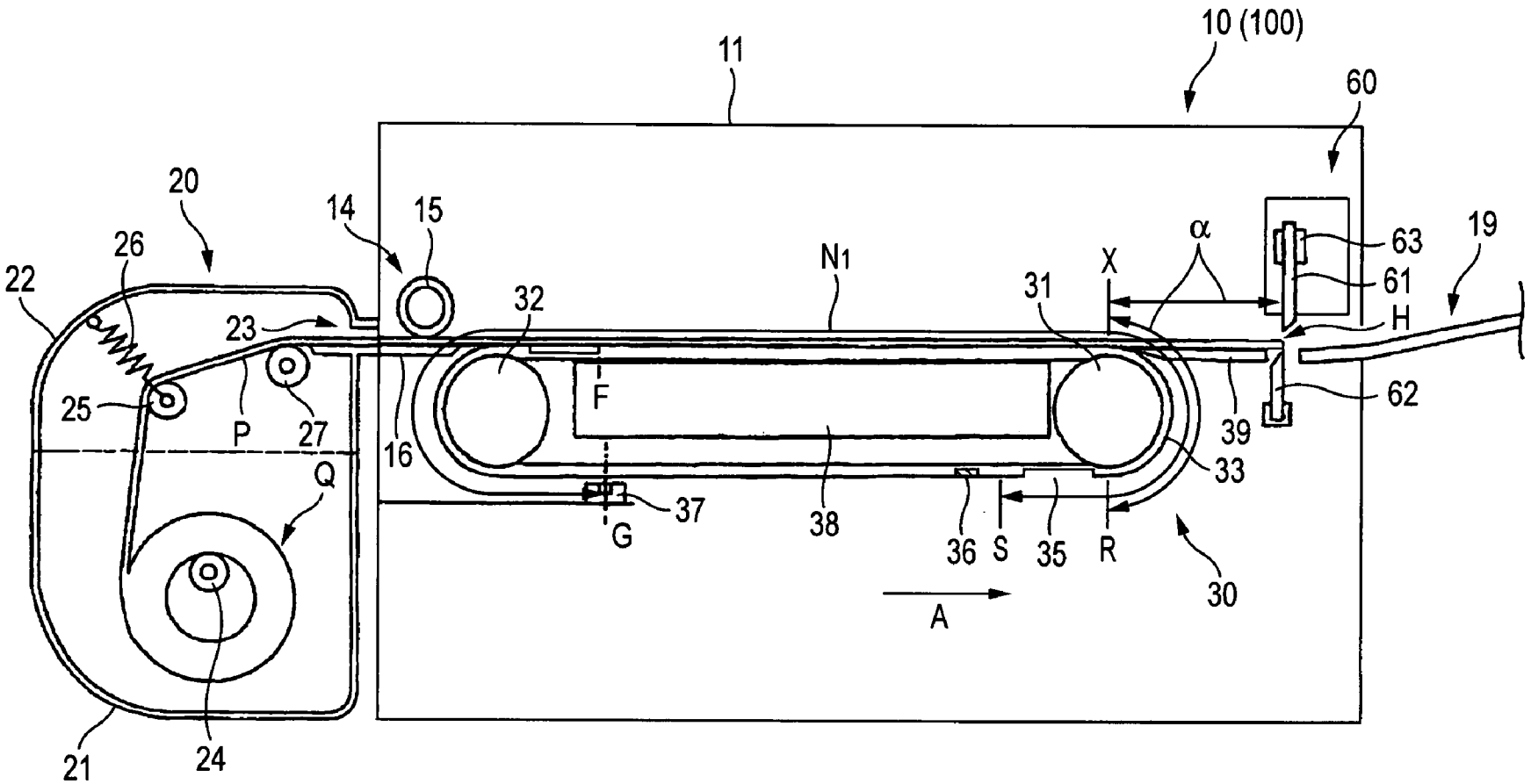
FIG. 1C shows a state where a conveyance motor 77 rotates N1 times after the state shown in FIG. 1B.
Figure 1D:
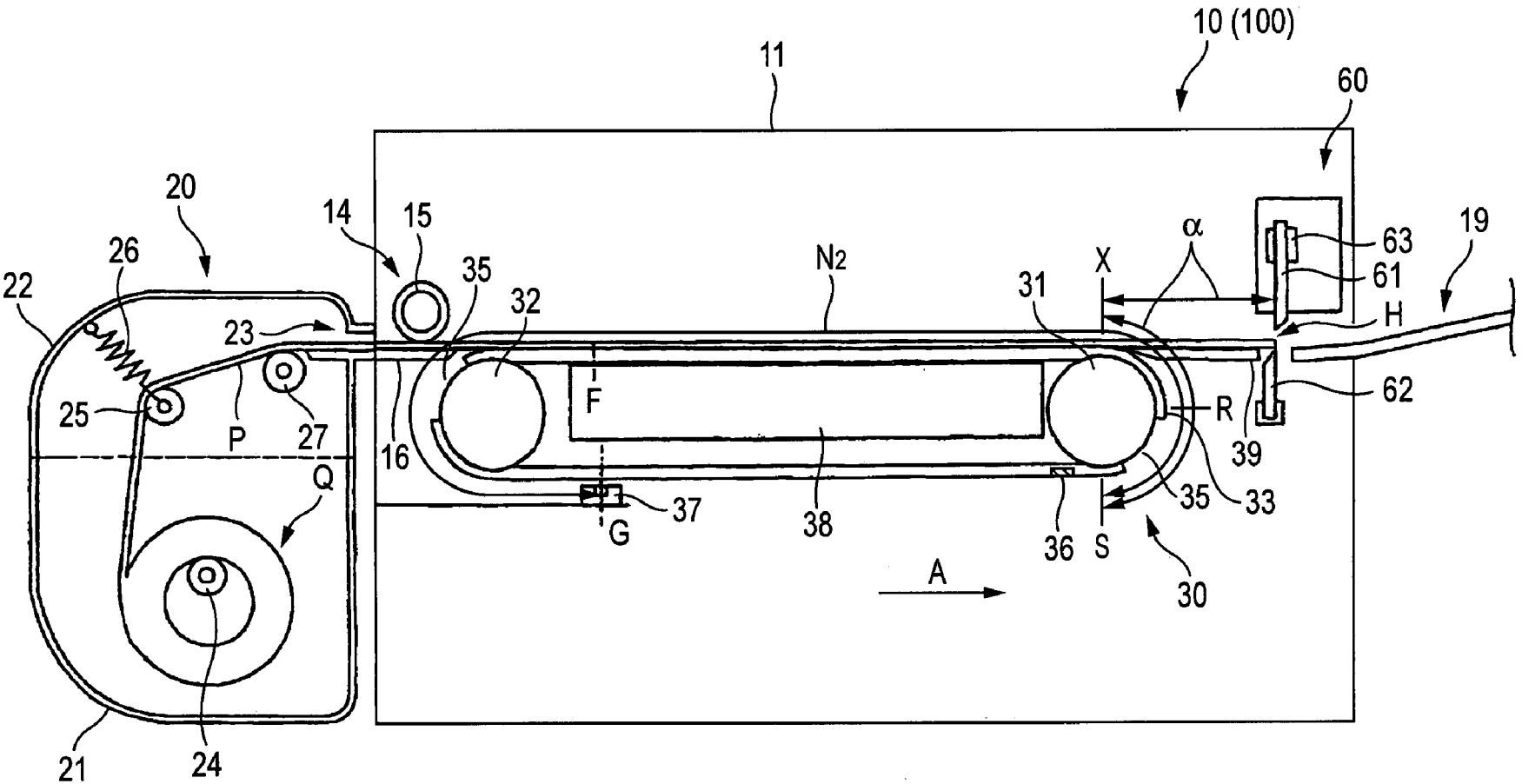
FIG. 1D shows a state where the conveyance motor 77 rotates N2 times after the state shown in FIG. 1B.

Based on the rotation step number n of the conveyance motor 77 after the origin detection sensor 37 detects the marker 36 (after the position of the ink reception groove 35 is detected) as described above, the CPU 71 judges whether or not the first cutting position C will be located in the predetermined region RS in the rewinding operation. The ROM 72 stores rotation step numbers N1 and N2, which are described below, in advance. It is assumed that a distance between a virtual point X and the cutting position H is a as shown in FIGS. 1B to 1D. If a distance between the virtual point X and the border R is equal to a as shown in FIG. 1C at the time when the roll paper P is cut at the first cutting position C, the first cutting position C of the roll paper P will be located at the border R in the rewinding operation as shown in FIG. 7B. The rotation step number N1 corresponds to a distance between the detection position G and a position of the marker 36 shown in FIG. 1C. In other words, the rotation step number N1 corresponds to a travel distance of the conveyance belt 33 from a timing when the origin detection sensor 37 detects the marker 36 to a timing when a to-be-cut position (which will be the first cutting position C after cutting) of the roll paper P reaches the cutting position H in a case where the to-be-cut position of the roll paper P is located on the border R during the to-be-cut position being on the conveyance belt 33. If the origin detection sensor 37 detects the marker 36 as shown in FIG. 1B and then the conveyance motor 77 rotates N1 times, the ink reception groove 35 is moved from the position shown in FIG. 1B to the position shown in FIG. 1C.

If a distance between the virtual point X and the border S is equal to $\alpha$ as shown in FIG. 1D in a case where the roll paper P is cut at the first cutting position C, the first cutting position C of the roll paper P will be located at the border S in the rewinding operation as shown in FIG. 7C. The rotation step number N2 corresponds to a distance between the detection position G and a position of the marker shown in FIG. 1D. In other words, the rotation step number N2 corresponds to a travel distance of the conveyance belt 33 from the timing when the origin detection sensor 37 detects the marker 36 to the timing when the to-be-cut position of the roll paper P reaches the cutting position H in a case where the to-be-cut position of the roll paper P is located on the border S during the to-be-cut position being on the conveyance belt 33. If the origin detection sensor 37 detects the marker 36 as shown in FIG. 1B and then the conveyance motor 77 rotates N2 times, the ink reception groove 35 is moved from the position shown in FIG. 1B to the position shown in FIG. 1D.

In FIGS. 1B to 1D, the virtual point X is set above the belt roller 33. However, it should be understood that the virtual point X may be set at a desirable position on the conveyance path of the roll paper P.

The CPU 71 compares the rotation step number n of the conveyance motor 77 after the origin detection sensor 37 detects the marker 36 (after the position of the ink reception groove 35 is detected) with the rotation step numbers N1 and N2 of the conveyance motor 77, and judges whether or not the rotation step number n is in a range of the rotation step number N2 to the rotation step number N1. When the rotation step number n is in a range of the rotation step number N2 to the rotation step number N1 (S24: YES), the first cutting position C will be located in the predetermined region RS. In this event, the CPU 71 makes the conveyance unit 30 convey the storage portion-side roll paper further downstream in the medium conveyance direction so as to perform the second cutting operation (S25), and makes the cutting mechanism 60 cut the storage portion-side roll paper again (S26).

The distance by which the storage portion-side roll paper is conveyed in S25 is a distance corresponding to a case where the conveyance motor 77 is rotated forwardly by the value (N1−n) obtained by subtracting the value n from the rotation step number N1. As shown in FIG. 7A, when the distance between the first cutting position C and the border R of the conveyance belt 33 is h, the distance h corresponds to the traveling distance of the conveyance belt 33 when the conveyance motor 77 is driven by the value obtained by subtracting the value n from the rotation number step N1. Accordingly, after the conveyance motor 77 is rotated forward by the rotation step number (N1−n), the storage portion-side roll paper is cut again, and the rewinding operation is performed. In this event, in the state shown in FIG. 7B, the downstream front end of the storage portion-side roll paper in the medium feed direction is located at a position facing the border R of the conveyance belt 33.

Incidentally, when the first cutting position C is not located in the predetermined region RS at the time of rewinding (S24: NO), it is not necessary to perform the second cutting operation. Thus, the CPU 71 jumps from the processing of S24 to the processing of S27.

When the storage portion-side roll paper is rewound after the operation of cutting the roll paper P is terminated, the CPU 71 moves down the second arm 52 so as to allow the second pressure roller 51 to press the roll paper P onto the conveyance belt 33 (S27). Thus, the downstream portion of the storage portion-side roll paper in the medium feed direction, which has been released from the conveyance belt 33, is brought into close contact with the conveyance belt 33 again.

Next, the CPU 71 moves up the first arm 42 so that the first pressure roller 41 leaves the conveyance belt 33 (S28) Incidentally, when the storage portion-side roll paper is rewound with the first pressure roller 41 pressing the storage portion-side roll paper, flexure may occur on the downstream side of the first pressure roller 41 in the medium feed direction due to the friction between the storage portion-side roll paper and the first pressure roller 41. In this case, the flexed portion may touch the inkjet heads 12 so that the storage portion-side roll paper is contaminated with ink.

When the first pressure roller 41 leaves the conveyance belt 33, the CPU 71 begins rotating the conveyance motor 77 backward so as to rotate the conveyance belt 33 backward (S29) In this event, as described previously, the storage portion-side roll paper released from the conveyance belt 33 is brought into close contact with the conveyance belt 33 again by the second pressure roller 51.

When the conveyance belt 33 begins rotating backward, the CPU 71 monitors the second paper sensor 18 as to whether or not the second paper sensor 18 detects the front end of the storage portion-side roll paper (S30). When the second paper sensor 18 detects the downstream front end of the storage portion-side roll paper (S31: YES), the storage portion-side roll paper is rewound to a position (between the first paper sensor 17 and the conveyance belt 33) where the downstream front end of the storage portion-side roll paper will be released from the conveyance belt 33, and the conveyance belt 33 is stopped (S31). After the conveyance belt 33 is stopped, the CPU 71 moves up the second arm 52 (S32), and terminates the printing operation.

With the aforementioned procedure, in the inkjet printer 10 according to this example, there is no fear that the downstream front end of the storage portion-side roll paper falls into any ink reception groove 35 even when the operation of rewinding the roll paper P is performed. Thus, there is no fear that the roll paper P is contaminated with ink adhering to the ink reception groove 35. In addition, the downstream front end of the storage portion-side roll paper is surely brought into close contact with the conveyance belt 33. Thus, the storage portion-side roll paper can be prevented from being separated from the conveyance belt 33 to thereby touch the ejection surfaces 13*a*. As a result, ink can be prevented from adhering to the storage portion-side roll paper, and the ejection surfaces 13*a* can be prevented from being injured.

EXAMPLE 2

Next, a second example of the invention will be described with reference to the drawings.

An inkjet printer 100 according to this example has the same configuration as the inkjet printer 10 according to Example 1, except the following point. Parts corresponding to those in the inkjet printer 10 are denoted by the same reference numerals correspondingly, and description thereof will be omitted.

The inkjet printer 100 according to this embodiment is different from the inkjet printer 10 according to the example 1 in that the second paper sensor 18 is not provided; that programs and data, which are stored in the ROM 72 and operate the CPU 71, are different; and that a control method used in the printing operation is different. Accordingly, the following description will be made on the assumption that the ink-jet printer 10 according to the example 1 excluding the second paper sensor 18 is replaced by the inkjet 100 according to this example, and the programs and data, which are stored in the ROM 72 and operate the CPU 71, are different from those in the example 1.

In the example 1, as described previously, the roll paper P is cut at the first cutting position C after an image is formed on the roll paper P, and the second cutting operation is performed when the first cutting position C is located in the predetermined region RS including the ink reception groove 35 at the time of rewinding. In this example, before the roll paper P is fed out onto the conveyance belt 33 by the paper feed roller 15, the first cutting position C is determined based on the length of an image to be printed on the roll paper P, and the driving timing of the paper feed roller 15 is controlled to prevent the first cutting position C from being located in the predetermined region RS of the conveyance belt 33. Incidentally, in this example, the first cutting position C is set as a position where the roll paper P is cut upstream in the medium feed direction with respect to the region where the image is formed in the roll paper P after the image formation. In addition, when there are a plurality of images, the first cutting position C is set upstream in the medium feed direction with respect to the region where the last image is formed.

Figure 8:
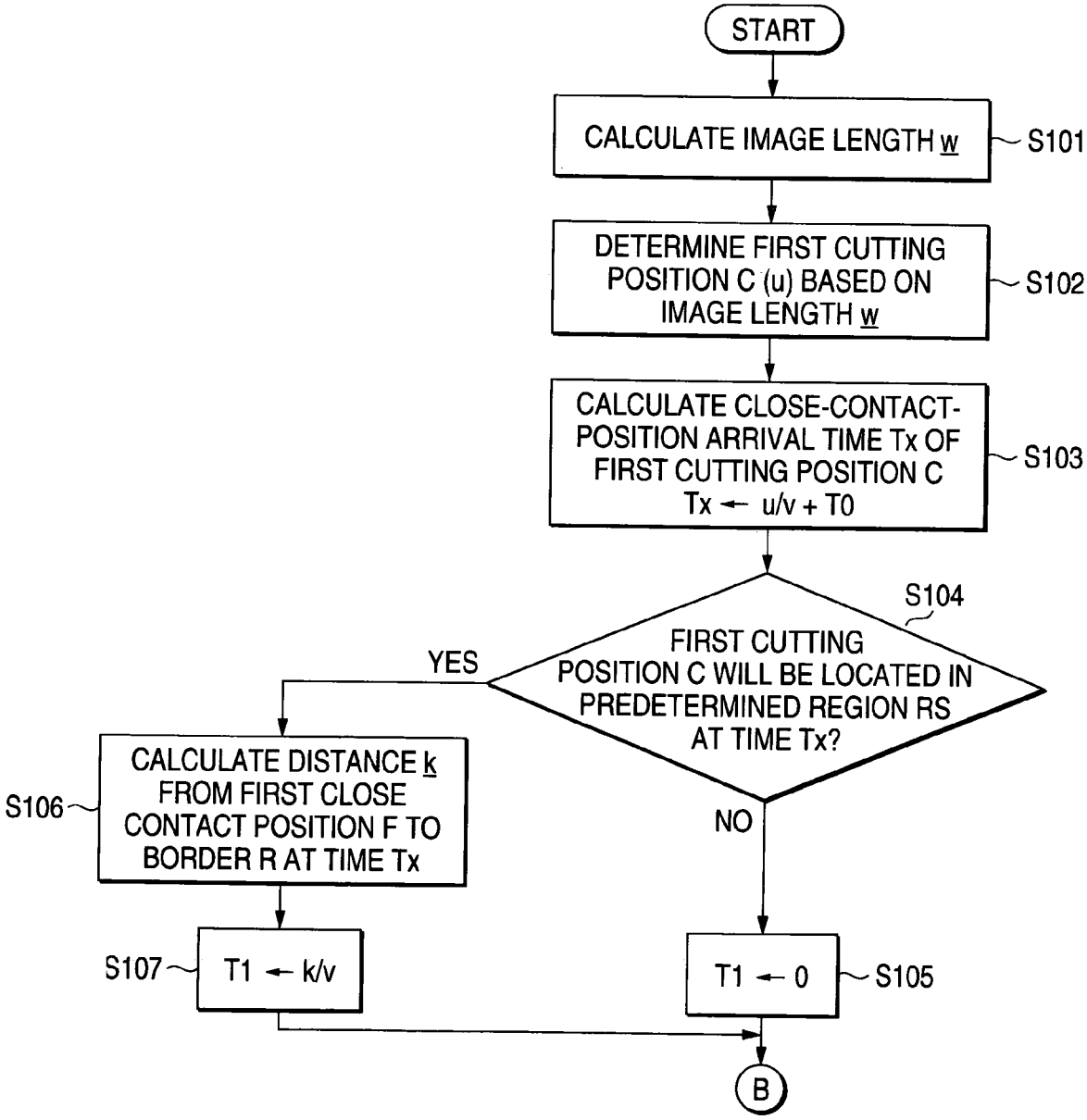
FIG. 8 is an operation flow chart showing the outline of a printing operation in Embodiment 2.
Figure 9:
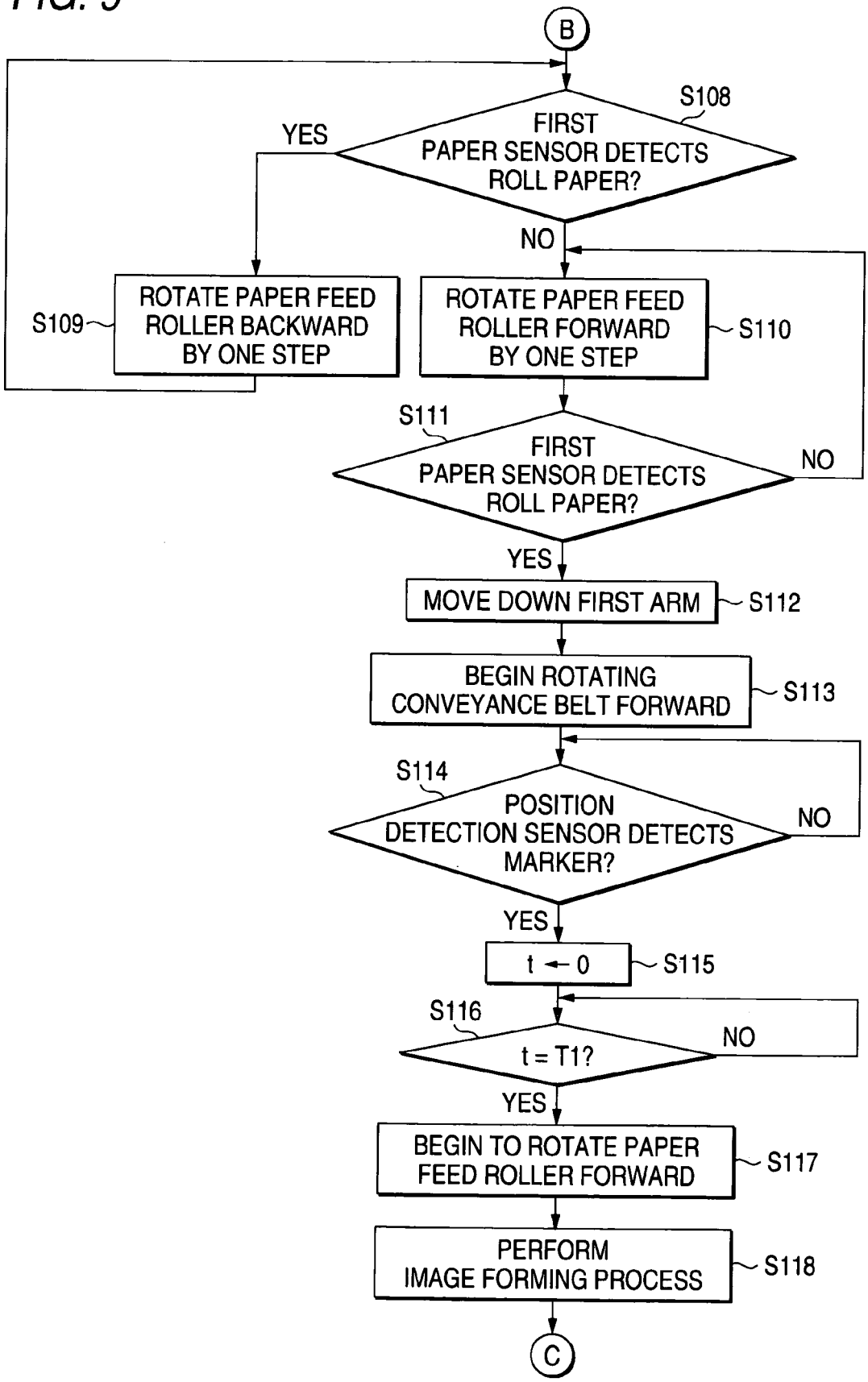
FIG. 9 is an operation flow chart showing the outline of the printing operation in Embodiment 2.
Figure 10:
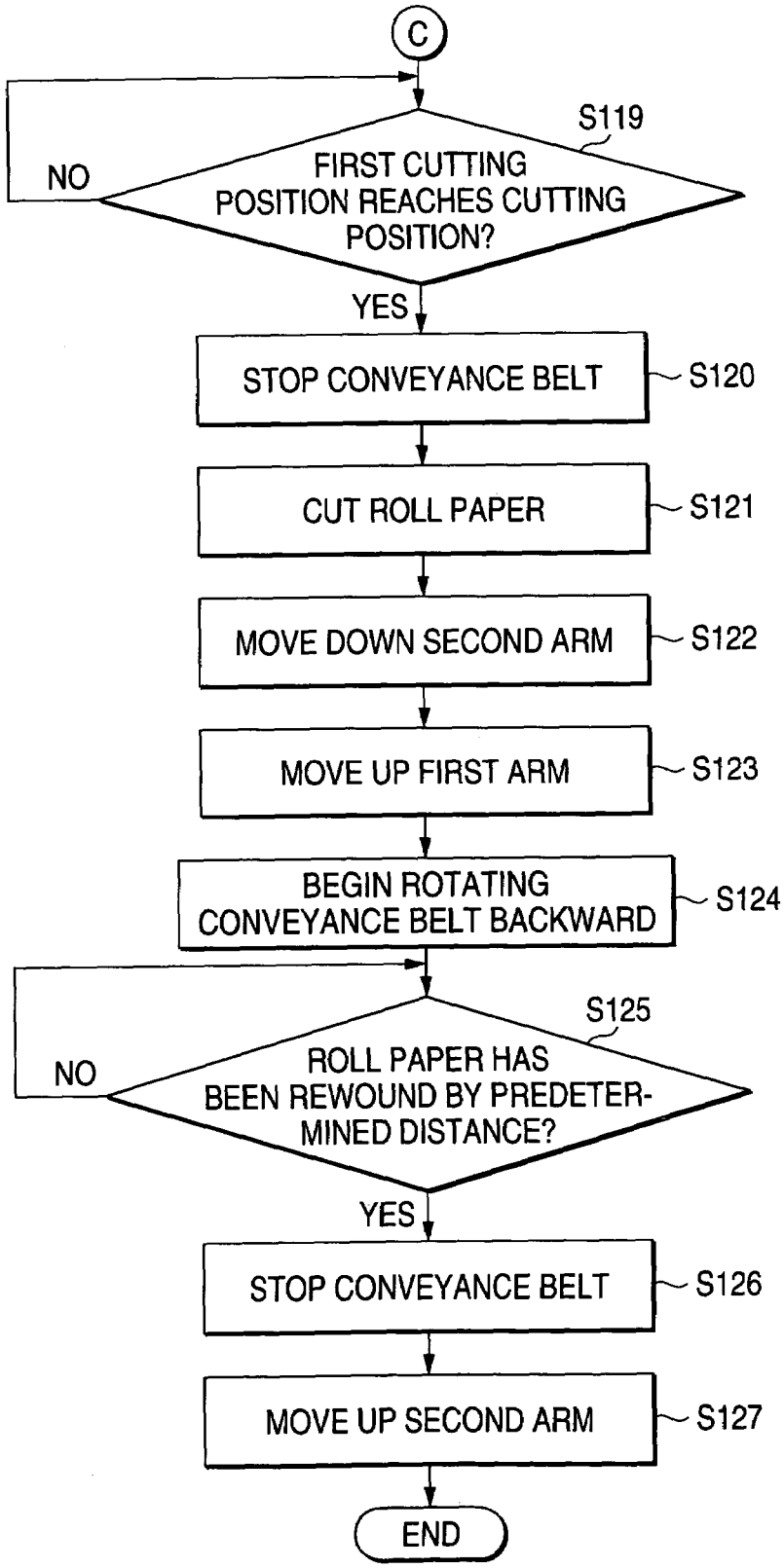
FIG. 10 is an operation flow chart showing the outline of the printing operation in Embodiment 2.
Figure 11A:
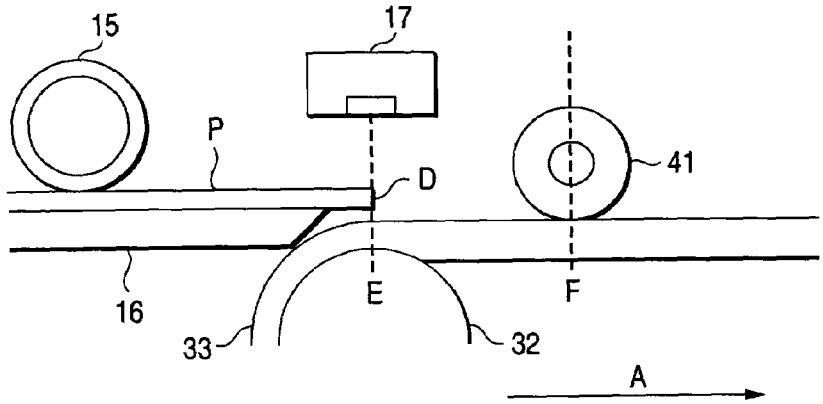
FIGS. 11A to 11C are views showing the state of the vicinity of a paper feed portion observed from the width direction of a conveyance belt.
Figure 11B:
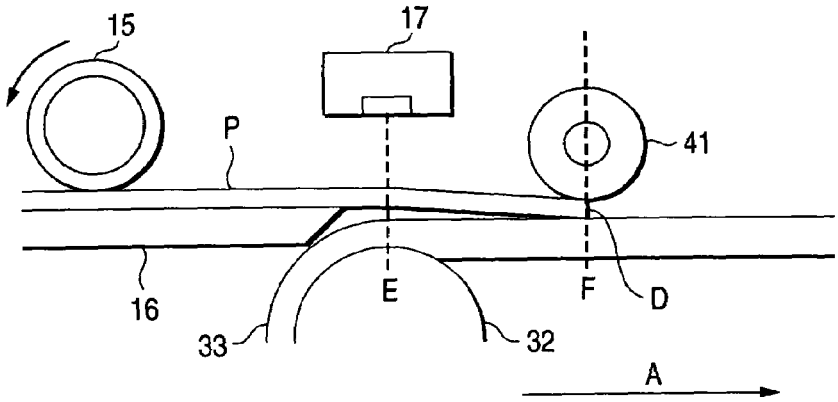
Figure 11C:
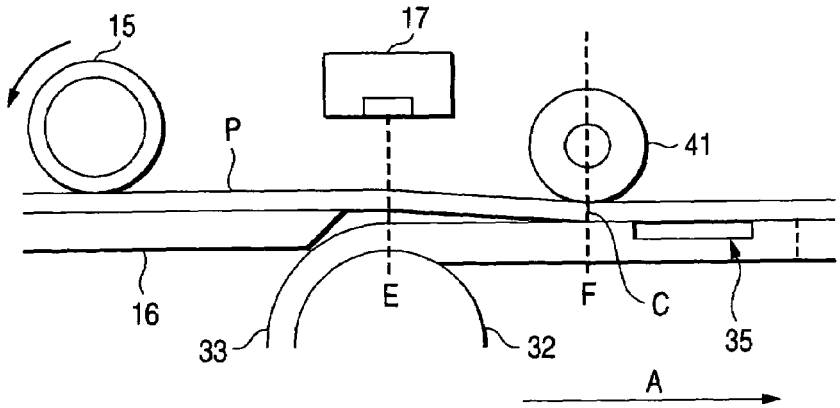

The printing operation to be executed by the inkjet printer 100 configured thus will be described with reference to FIGS. 8 to 10 and FIGS. 11A to 11C. FIGS. 8 to 10 are operation flow charts schematically showing the printing operation in the inkjet printer 100. FIGS. 11A to 11C are explanatory views observed from the width direction of the conveyance belt 33, showing the circumstances of the periphery of the paper feed portion 14 at the time of the printing operation. Incidentally, it is assumed that the CPU 71 generates print data including the timing with which ink will be ejected in each inkjet head 12 and so on in advance before executing the printing operation, which will be described below, based on a print instruction signal received through the external interface 86. In addition, it is assumed that the roll paper P is set beforehand at a position where the roll paper P is in contact with the paper feed roller 15. Further, in the inkjet printer 100 according to this example, the position of the origin detection sensor 37 is set as follows. That is, when the paper front end D of the roll paper P is located at an initial position E (in this example, the position where the paper front end D faces the first paper sensor 17), the paper front end D will not be located in the predetermined region RS even if paper feeding is initiated as soon as the origin detection sensor 37 detects the marker 36. Further, the paper front end D will not be located in the predetermined region RS even if paper feeding is initiated after the conveyance belt 33 moves by a distance as long as the width of the predetermined region RS in the medium feed direction.

Before starting the paper feed operation, which will be described later, the CPU 71 first determines paper feed timing T1 corresponding to a distance by which the conveyance belt 33 will move after the marker 36 is detected and until the paper feed roller 15 initiates feeding the roll paper P. The paper feed timing T1 is time (or the rotation step number n of the conveyance motor 77 corresponding to the traveling distance (paper feed start distance) of the conveyance belt 33) required till the paper feed roller 15 initiates feeding the roll paper P after the marker 36 is detected. The paper feed timing T1 is determined by the feed control function (feed control unit) of the CPU 71 implemented by the programs and data stored in the ROM 72.

First, in Step 101 in FIG. 8, the CPU 71 calculates the image length w (see FIG. 6), which is the medium-feed-direction length of an image to be formed on the roll paper P, on the basis of the aforementioned print data. Based on the image length w, the CPU 71 calculates a length u from the paper front end D of the roll paper P to the first cutting position C (S102). Incidentally, the length u is a length with which predetermined blanks are provided on the upstream and downstream sides of the image length w in the medium feed direction. In addition, the CPU 71 has an image length calculating function (image length calculating unit) and a cutting position determining function (cutting position determining unit) to execute the processing of S101 to S102 using the programs in the ROM 72.

Next, the CPU 71 calculates time Tx (close-contact-position arrival time) required for the first cutting position C to reach a position (first close contact position F) where the first cutting position C is pressed onto the conveyance belt 33 by the first pressure roller 41 (state of FIG. 11C) after the paper front end D of the roll paper P is located at the initial position E (state of FIG. 11A) and paper feeding is initiated (S103).

Description will be made below on the method for calculating the close-contact-position arrival time Tx. Incidentally, the time TO between the time when the paper front end D of the roll paper P is located at the initial position E as shown in FIG. 11A and the time when the paper front end D of the roll paper P fed out by the paper feed roller 15 reaches the first close contact position F as shown in FIG. 11B is stored in the ROM 72 in advance. The length u is divided by the moving rate v (conveyance belt moving speed) of the conveyance belt 33 per unit time, so as to obtain the time required till the first cutting position C in the state shown in FIG. 11B reaches the first close contact position F as shown in FIG. 11C. The aforementioned time TO is added to the time u/v obtained thus. Thus, the close-contact-position arrival time Tx can be obtained.

Next, after calculating the close-contact-position arrival time Tx, the CPU 71 identifies the position of the predetermined region RS when the first cutting position C reaches the first close contact position F, that is, when the time Tx has passed since the origin detection sensor 37 detected the marker 36. The position of the predetermined region RS at the time Tx can be identified in the following method. That is, first, the position can be identified by obtaining the distance by which the conveyance belt 33 moves for the time Tx, which is a value obtained by multiplying the close-contact-position arrival time Tx by the conveyance belt moving speed v. Incidentally, in this example, the predetermined regions RS are set at two places corresponding to the ink reception grooves 35, respectively. If the position of one of the predetermined regions RS can be identified, the position of the other region RS can be identified because the ink reception grooves 35 are provided at an equal interval on the conveyance belt 33.

Next, based on the positions of the predetermined regions RS at the close-contact-position arrival time Tx, the CPU 71 judges whether or not the first cutting position C will be located in one of the two predetermined regions RS when feeding the roll paper P is initiated as soon as the origin detection sensor 37 detects the marker 36 (S104).

When it is concluded that the first cutting position C will not be located in any predetermined region RS (S104: NO), the paper feed timing T1 is set to be "0" (S105). That is, in this example, the idle traveling distance is set to be "0". On the contrary, when it is concluded in S104 that the first cutting position C will be located in one of the predetermined regions RS (S104: YES), the distance k between the first close contact position C and the border R is calculated based on the position of the border R at the time Tx (S108). After that, the CPU 71 sets, as the paper feed timing T1, the value (k/v) obtained by dividing the distance k by the conveyance belt moving speed v (S109). When paper feeding is initiated after the time corresponding to the paper feed timing T1 (=k/v) has passed since the origin detection sensor 37 detected the marker 36, the first cutting position C will be opposed just to the border R.

When the paper feed timing T1 is determined, the CPU 71 first rotates the paper feed roller 15 forward or backward so as to move the roll paper P in order to locate the paper front end D of the roll paper P at the initial position E between the paper feed roller 15 and the position where the conveyance belt 33 is disposed. In Step S108 shown in FIG. 9, the CPU 71 judges whether or not the first paper sensor 17 (functioning as a front end detection unit) detects the roll paper P. When the roll paper P is detected (S108: YES), the paper front end D of the roll paper P is located on the conveyance belt 33 side with respect to the initial position E. Accordingly, the CPU 71 rotates the paper feed roller 15 of the roll paper P backward by one step (rotates the paper feed motor 79 by one step. The same thing will be applied to the following cases.) (Step 109), and makes a judgment in S108 again as to whether or not the roll paper P is detected. The CPU 71 repeats the processing of S108 to S109 till the first paper sensor 17 detects the roll paper P.

When the roll paper P is not detected in S108 (S108: NO), the paper front end D of the roll paper P is located on the paper feed roller 15 side with respect to the initial position E. Accordingly, the CPU 71 rotates the paper feed roller 15 forward by one step (S110). After that, the CPU 71 judges whether or not the first paper sensor 17 detects the roll paper P. When the roll paper P is not detected (S111: NO), the paper front end D of the roll paper P is regarded as still located on the paper feed roller 15 side with respect to the initial position E. Thus, the CPU 71 returns to the processing of S110. On the contrary, when the first paper sensor 17 detects the roll paper P (S111: YES), the paper front end D of the roll paper P is regarded as located at the initial position E. Thus, the CPU 71 advances to the processing of S112. Incidentally, in this example, the initial position E is a position where the first paper sensor 17 detects the paper front end D. The initial position E may be provided desirably between the first paper sensor 17 and the first close contact mechanism 40.

In S112, the CPU 71 moves down the first arm 42 so that the pressure roller 41 of the first close contact mechanism 40 is located at a position where the pressure roller 41 presses the conveyance belt 33.

After the first arm 42 moves down, the CPU 71 rotates the conveyance motor 77 forward to rotate the conveyance belt 33 forward in order to convey the roll paper P in the medium feed direction (S113). After that, the CPU 71 monitors the detection signal of the origin detection sensor 37 as to whether or not the marker 36 provided in the conveyance belt 33 has passed a detection position G (S114). In this event, the CPU 71 resets the rotation step number n of the conveyance motor 77 stored in the RAM 73 to be "0". Based on the rotation step number n of the conveyance motor 77, the CPU 71 calculates the traveling distance of the conveyance belt 33 after the origin detection sensor 37 detects the marker 36. Thus, the CPU 71 identifies the position of the ink reception groove 35.

When the origin detection sensor 37 detects the marker 36 in S114 (S114: YES), the CPU 71 sets a timing counter t to be "0" and starts counting (S115). The CUP 71 monitors the timing counter t as to whether or not the timing counter t reaches the paper feed timing T1 (S116).

When the timing counter t is identical to the paper feed timing T1 (S116: YES), the CPU 71 rotates the paper feed motor 79 forward (S117). When the paper feed motor 79 rotates forward, the roll paper P is fed out from the roll paper cassette 20 by the paper feed roller 15 so that the paper front end of the roll paper P is fed onto the conveyance belt 33. In such a manner, the timing with which paper feeding is initiated after the origin detection sensor 37 detects the marker 36 is controlled based on the paper feed timing T1, so that the roll paper P is cut at the first cutting position C and rewound. In this event, the first cutting position C can be surely prevented from being located in the predetermined region RS.

The roll paper P fed by the paper feed roller 15 reaches the first close contact position F while facing the conveyance belt 33. When the roll paper P reaches the first close contact position F, the roll paper P is pressed onto the conveyance belt 33 by the first pressure roller 41 so as to come into close contact with the conveyance belt 33. Incidentally, the paper feed roller 15 is controlled to stop at the time (time Tx) when the first cutting position C reaches the first close contact position F.

As soon as the roll paper P conveyed on the conveyance belt 33 reaches the image formation start position, the CPU 71 drives the inkjet heads 12 based on the aforementioned print data so as to form an image while conveying the roll paper P (S118).

After the image formation process by the inkjet heads 12 is terminated, the CPU 71 monitors the first cutting position C as to whether or not the first cutting position C reaches the cutting position H, in order to cut the roll paper P at the first cutting position C and discharge it to the discharge portion 19 (S119).

When the front end of the roll paper P reaches the position where the release plate 39 is disposed, the roll paper P is released from the conveyance belt 33 by the release plate 39, and fed out to the cutting position H as it is. When the first cutting position C of the roll paper P is conveyed to the cutting position H (S119: YES), the CPU 71 stops the conveyance belt 33 (S120), and the roll paper P is cut at the first cutting position C (S121).

After the roll paper P is cut at the first cutting position C, the roll paper (storage portion-side medium, which will be hereinafter referred to as "storage portion-side roll paper") on the retraction cassette 20 side with respect to the first cutting position C is rewound in an opposite direction to the medium feed direction by the backward rotation of the conveyance belt 33 based on an instruction from the CPU 71.

When the storage portion-side roll paper is rewound after the operation of cutting the roll paper P is terminated, the CPU 71 moves down the second arm 52 so as to allow the second pressure roller 51 to press the roll paper P onto the conveyance belt 33 (S122). Thus, of the storage portion-side roll paper, the portion released from the conveyance belt 33 is brought into close contact with the conveyance belt 33 again. The CPU 71 moves up the first arm 42 so that the first pressure roller 41 leaves the conveyance belt 33 (S123).

Next, the CPU 71 rotates the conveyance motor 77 backward so as to rotate the conveyance belt 33 backward (S124). In this event, as described previously, the storage portion-side roll paper released from the conveyance belt 33 is brought into close contact with the conveyance belt 33 again by the second pressure roller 51.

When the conveyance belt 33 begins rotating backward, the CPU 71 monitors the first cutting position C (downstream front end) of the storage portion-side roll paper as to whether or not the first cutting position C has been rewound by a predetermined distance to be located upstream in the medium feed direction with respect to the first close contact position F (S125). When the first cutting position C has been rewound by the predetermined distance (S125: YES), the CPU 71 stops the conveyance belt 33 (S126), moves up the second arm 52 (S127), and terminates the printing operation.

With the aforementioned procedure, in the inkjet printer 100 according to this example, there is no fear that the downstream front end of the storage portion-side roll paper falls into any ink reception groove 35 even when the operation of rewinding the roll paper P is performed. Thus, there is no fear that the roll paper P is contaminated with ink adhering to the ink reception groove 35. In addition, the downstream front end of the storage portion-side roll paper is surely brought into close contact with the conveyance belt 33. Thus, the storage portion-side roll paper can be prevented from being separated from the conveyance belt 33 to thereby touch the ejection surfaces 13*a*. As a result, ink can be prevented from adhering to the storage portion-side roll paper, and the ejection surfaces 13*a* can be prevented from being injured.

Although the preferred embodiments and examples of the invention have been described above, it should be understood that the invention is not limited to the embodiments and examples. Modifications to the embodiments and examples can be made suitably.

For example, various methods can be used as the method for controlling the printing operation to be carried out by the CPU 71. The procedures or calculating expressions shown in the flow charts used in the aforementioned explanation do not always have to be used.

Although the marker 36 (origin) is detected to identify the position of the predetermined region RS in the aforementioned embodiments, the invention is not limited to this method. For example, the position of the ink reception groove 35 may be detected and identified by a sensor for detecting the thickness of the conveyance belt 33.

The predetermined region RS, which is set not to allow the downstream front end of the storage portion-side roll paper to be located therein in the rewinding operation, may be set in a range including at least the ink reception groove 35. The range of the predetermined region RS can be changed in accordance with the convenience of design. It is, however, preferable to set the predetermined region RS to have a certain degree of width at least on the downstream side of the ink reception groove 35 in the medium feed direction.

Although the ink reception groove 35 has a groove shape with a bottom in the aforementioned embodiments and examples, an opening portion penetrating the conveyance belt 33 may be provided in the bottom.

The shape of the ink reception groove 35 viewed in a direction perpendicular to the outer circumferential surface of the conveyance belt 33 does not have to be rectangular as in the embodiments if it is a shape capable of surely receiving ink at the time of flushing operation. In this case, the range of the predetermined region RS has to be set to include at least a range between the most upstream edge and the most downstream edge of the ink reception groove 35 in the medium feed direction.

Both the first and second close contact mechanisms 40 and 50 press rollers onto the conveyance belt 33 to thereby bring the roll paper P into close contact with the conveyance belt 33. However, their configurations are not limited especially if they are mechanisms capable of bringing the roll paper P into close contact. For example, the close contact may be achieved using the air pressure.

Without using the conveyance belt for conveying the roll paper P, for example, the roll paper P maybe carried and conveyed on the outer circumferential surface of a drum body whose surface is adhesive.

The embodiments and examples have been described on the case where an inkjet printer is used as image forming apparatus by way of example. The invention is not particularly limited thereto, but may be applicable to image forming apparatus in which a long continuous medium is conveyed on a conveyance belt having adhesiveness, and rewound after printing.

The invention is applicable to apparatus having an image forming function, such as an inkjet printer or a facsimile machine, in which ink is ejected onto a long printing medium such as roll paper so as to form an image, and ink is ejected onto a conveyance belt so as to perform a flushing operation. The invention has industrial applicability.

What is claimed is:

1. An inkjet printer comprising:

an inkjet head that ejects ink onto a printing medium to form an image thereon;

a conveyance belt that defines on an outer circumferential surface thereof a groove extending in a direction intersecting with a conveyance direction;

a conveyance mechanism that drives the conveyance belt to travel in the conveyance direction and in a direction opposite to the conveyance direction;

a cutting mechanism that is disposed downstream in the conveyance direction with respect to the conveyance belt and cuts the printing medium;

a control unit that controls at least the conveyance mechanism and the cutting mechanism; and a judgment unit that, after the cutting mechanism cuts the printing medium, judges whether or not a cut position of the printing medium will be located in a predetermined region of the conveyance belt if the conveyance mechanism drives the conveyance belt to convey the printing medium in the direction opposite to the conveyance direction, wherein:

the predetermined region of the conveyance belt includes the groove;

when the judgment unit judges that the cut position of the printing medium will be located in the predetermined region, the control unit controls the conveyance mechanism to convey the printing medium on the conveyance belt in the conveyance direction and subsequently controls the cutting mechanism to cut the printing medium; and when the judgment unit judges that the cut position of the printing medium will not be located in the predetermined region, the control unit controls the conveyance mechanism to convey the printing medium on the conveyance belt in the direction opposite to the conveyance direction.

2. The inkjet printer according to claim 1, wherein when the judgment unit judges that the cut position of the printing medium will not be located in the predetermined region or the cutting mechanism cuts the printing medium twice, the control unit controls the conveyance mechanism to convey the printing medium on the conveyance belt in the direction opposite to the conveyance direction.

3. The inkjet printer according to claim 1, further comprising:

an origin detection sensor that faces the outer circumferential surface of the conveyance belt, wherein:

the conveyance belt includes an origin thereon;

the origin detection sensor detects the origin of the conveyance belt; and after the cutting mechanism cuts the printing medium, the judgment unit judges based on a detection result of the origin detection sensor whether or not the cut position of the printing medium will be located in the predetermined region if the conveyance mechanism drives the conveyance belt to convey the printing medium in the direction opposite to the conveyance direction.

4. The inkjet printer according to claim 3, further comprising:

a storage unit that stores a first distance and a second distance, wherein:

the first distance represents a travel distance of the conveyance belt from a first timing to a second timing in a case where a to-be-cut position of the printing medium is located on an upstream end of the predetermined region in the conveyance direction during the to-be-cut position of the printing medium being on the conveyance belt;

the second distance represents a travel distance of the conveyance belt from the first timing to the second timing in a case where the to-be-cut position of the printing medium is located on a downstream end of the predetermined region in the conveyance direction during the to-be-cut position of the printing medium being on the conveyance belt;

the first timing is a timing at which the origin detection sensor detects the origin of the conveyance belt;

the second timing is a timing at which the to-be-cut position of the printing medium reaches a position where the cutting mechanism cuts the printing medium;

the judgment unit includes:

a distance calculation unit that calculates a travel distance of the conveyance belt from the first timing to the second timing;

when the travel distance calculated by the distance calculation unit is in a range of the second distance to the first distance, the judgment unit judges that the cut position of the printing medium will be located in the predetermined region if the conveyance mechanism drives the conveyance belt to convey the printing medium in the direction opposite to the conveyance direction.

5. The inkjet printer according to claim 4, wherein:

the control unit includes:

a subtraction unit that subtracts the travel distance calculated by the distance calculation unit from the first-distance to obtain a subtraction result;

when the judgment unit judges that the cut position of the printing medium will be located in the predetermined region, the control unit controls the conveyance mechanism to convey the printing mechanism on the conveyance belt by at least the subtraction result in the conveyance direction and subsequently controls the cutting mechanism to cut the printing medium.

6. The inkjet printer according to claim 3, wherein:

the conveyance belt includes a to-be-detected member at the origin thereof; and the origin detection sensor detects the to-be-detected member to detect the origin of the conveyance belt.

7. The inkjet printer according to claim 1, further comprising:

a storage portion that rolls and stores at least a part of the printing medium; and a first close contact mechanism that is disposed upstream in the conveyance direction with respect to the inkjet head and brings the printing medium into close contact with the conveyance belt, wherein:

the conveyance belt is an endless type conveyance belt and has an adhesiveness due to which the printing medium is closely contactable with the conveyance belt;

the conveyance direction heads from the storage portion to the inkjet head; and the control unit includes:

a first cutting control unit that controls the cutting mechanism to cut the printing medium at the cut position, which is located upstream in the conveyance direction with respect to a region where the image is formed; and a second cutting control unit that, when the judgment unit judges that the cut position of the printing medium will be located in the predetermined region, controls the conveyance mechanism to convey the printing mechanism on the conveyance belt in the conveyance direction and subsequently controls the cutting mechanism to cut the printing medium.

8. The inkjet printer according to claim 1, wherein:

the predetermined region includes a region where the groove is defined and an adjacent region having a predetermined width in the conveyance direction.

9. The inkjet printer according to claim 8, wherein the adjacent region is located downstream with respect to the groove and is adjacent to the groove.

10. The inkjet printer according to claim 1, further comprising:

a second close contact mechanism that is disposed downstream with respect to the inkjet head and brings the printing medium into close contact with the conveyance belt when the conveyance belt conveys the printing medium in the direction opposite to the conveyance direction.

* * * * *